US005520526A

United States Patent [19]

Fujio

[11] Patent Number: 5,520,526

[45] Date of Patent: May 28, 1996

[54] SCROLL COMPRESSOR WITH AXIALLY BIASED SCROLL

[75] Inventor: Katuharu Fujio, Shiga, Japan

[73] Assignee: Matsushita Electric Industrial Co., Ltd., Osaka, Japan

[21] Appl. No.: 720,510

[22] PCT Filed: Oct. 31, 1990

[86] PCT No.: PCT/JP90/01402

§ 371 Date: Sep. 3, 1991

§ 102(e) Date: Sep. 3, 1991

[87] PCT Pub. No.: WO91/06765

PCT Pub. Date: May 16, 1991

[30] Foreign Application Priority Data

Oct. 31, 1989 [JP] Japan ..... 1-283561

[51] Int. Cl.[6] ..... F04C 18/04; F04C 27/00

[52] U.S. Cl. ..... 418/55.4; 418/55.5; 418/57; 418/142

[58] Field of Search ..... 418/55.5, 57, 55.4, 418/142

[56] References Cited

U.S. PATENT DOCUMENTS

| | | | |
|---|---|---|---|
| 3,994,636 | 11/1976 | McCullough et al. | 418/55.4 |
| 4,604,039 | 8/1986 | Terauchi | 418/57 |
| 4,968,232 | 11/1990 | Kikuchi | 418/55.5 |

FOREIGN PATENT DOCUMENTS

| | | | |
|---|---|---|---|
| 57-8386 | 1/1982 | Japan . | |
| 60-166783 | 8/1985 | Japan . | |
| 63-85277 | 4/1988 | Japan | 418/55.5 |
| 1177482 | 7/1989 | Japan . | |

*Primary Examiner*—John J. Vrablik
*Attorney, Agent, or Firm*—Watson Cole Stevens Davis

[57] ABSTRACT

The pressure of a discharged refrigerant gas introduced into a rotary scroll (18) in the portion opposing a compression chamber is utilized to urge the rotary scroll (18) toward the compression chamber so as to maintain the axial directional gap of the compression chamber at a small value. A tip seal (98) is disposed while allowing a small gap for a spiral tip seal groove (98) formed at only the front portion of a rotary scroll wrap (18*a*) so that the rotary scroll (18) is pushed toward a fixed scroll (15) by the urged pressure of the discharged refrigerant gas introduced into a back pressure chamber (39) of the rotary scroll (18). As a result, enlargement of the axial directional gap of the compression chamber is prevented. Therefore, the axial directional gap between the front portion of the spiral wrap of the rotary scroll (18) and the fixed scroll (15), which will easily generate a leakage of a compressed gas due to the deviation of the combination of the parts of the two scrolls, can be assuredly sealed by the tip seal (98*a*). A small gap (substantially no gap) can be easily secured in the axial directional gap between the front portion of the spiral wrap of the fixed scroll (15) and the rotary scroll (18). Therefore, it can be sealed without a tip seal so that the operation can be continued while reducing the compression leakage at the time of the normal operation.

2 Claims, 25 Drawing Sheets

SCROLL COMPRESSOR WITH AXIALLY BIASED SCROLL

TECHNICAL FIELD

The present invention relates to supply of oil to a bearing portion of a scroll compressor, a fluid path relating to it and passing through the back side portion of a scroll member and an apparatus for reducing an excessively compressed load generated due to the fluid and the fluid path.

BACKGROUND ART

A scroll compressor possessing low vibration and noise characteristics is arranged in such a manner that a suction chamber is disposed on the outer portion thereof, a discharge port is formed at the central portion of the spiral and the compressed fluid flows in a single direction. Therefore, a discharge valve for compressing the fluid, which has been conventionally provided for a reciprocating type compressors or a rotary type compressors, can be eliminated from the structure, and a constant compression ratio can be realized. Furthermore, the discharge pulsation can be reduced depending upon the operational conditions of the compressor and a necessity of having a large discharge space can be eliminated. Therefore, the development and application of the scroll compressor to a variety of fields in terms of the practical use have been made.

However, since its compression chamber must have a multiplicity of sealing portions, it suffers from an excessively large leakage quantity of the compressed fluid. In particular, it is necessary for a small discharge capacity type scroll compressor for use as a home air conditioning refrigerant compressor to extremely improve the dimensional accuracy of the spiral portion in order to minimize the gap in the compression portion from which the leakage will take place. However, the complicated shapes of the parts and the dimensional deviations of the spiral portion raise the cost of the scroll gas compressor, and uniform performance cannot easily be realized. In particular, the gas leakage cannot be easily prevented when the compressor is being operated at low speed because of the too long compression time. Therefore, there arises a problem that the compression efficiency is unsatisfactory in comparison to that obtainable from the reciprocating type compressors and the rotary type compressor.

In order to overcome the above-described problems, the dimensional accuracy of the spiral portion is made to be at a proper level and the compression efficiency is improved by the oil film seal effect by utilizing lubricating oil in order to prevent the gas leakage which will take place during the compression operation. As disclosed in Japanese Patent Laid-Open No. 57-8386, a proper quantity of lubricating oil is injected into the compression chamber, which is performing the compression operation, so as to seal the gaps of the compression chamber with the film of the lubricating oil so as to overcome the above-described problems.

In particular, the scroll refrigerant compressors have been put into practical use in a refrigerating and air conditioning fields. Therefore, medium to large size compressors such as a package air conditioner and a tiller unit and the like having a relatively large refrigerant capacity per one suction process have been already mass-produced.

FIG. 1 illustrates a structure arranged for the purpose of reducing the fluid leakage from the compressor chamber in such a manner that fluid of an intermediate pressure level introduced from outside the compressor via a fluid path 1130 is urged against the back side of a rotary scroll 1130 so as to push the rotary scroll 1130 toward a fixed scroll 1110. Furthermore, spiral seal members 1117, 1118 (1145, 1180) urged by springs 1170 and 1181 are fastened to a spiral groove 1146 (see FIGS. 2 and 3) formed at the front portions of the spiral wraps 1132 and 1116 of the two scrolls. As a result, the portion between a surface 1133 of an end plate 1131 of the rotary scroll 1130 and the front portion of a wrap 1116 of the fixed scroll 1110 and a portion between a surface 1136 of an end plate 1111 of the fixed scroll 1110 and a front portion 1149 of a lap 1132 of the rotary scroll 1130 are respectively sealed (specification of U.S. Pat. No. 3,994,636).

However, the structure arranged as shown in FIG. 1 in such a manner that the seal members 1117 and 1118 are fastened to the corresponding front portions of the two wraps 1132 and 1116 of the corresponding rotary scroll 1130 and the fixed scroll 1110 so as to axially seal the compression chamber encounters a problem in that the compressor will be damaged by the abnormal pressure rise generated due to the continuous liquid compression taking place in the compression chamber because the seal members 1117 and 1118 disposed at the two end portions prevent the cancellation of the sealing the compression chamber when the rotary scroll 1130 separates from the fixed scroll 1110 in the axial direction due to the generation of the liquid compression, which takes place in the compression chamber, to cancel the sealing of the compression chamber in the axial direction.

Accordingly, an object of a first invention of this application is to quickly leak the compressed fluid through an axial gap of the compression chamber so as to instantaneously lower the pressure when an abnormal pressure rise takes place in the compression chamber.

An object of a second invention is to provide a start load reduction device capable of reducing the start load of the compressor and improving the compression efficiency immediately after the start of the operation.

An object of a third invention is to provide a compressor exhibiting excellent durability of the sliding portion thereof and capable of eliminating vibrations and noise at the initial stage of the start of the operation by reducing the start load of the compressor and by gradually shifting the operation to the full compression mode with the lapse of time after the start of the operation.

In order to achieve the above-described objects, a first invention of a scroll compressor according to the present invention is characterized in that: a rotary scroll is disposed between a body frame supporting a drive shaft and stationarily connected to a fixed scroll and the fixed scroll while allowing a small axial directional movement; a seal member is disposed while allowing a small gap in a spiral groove formed at only the front portion of a spiral wrap of the rotary scroll; the rotary scroll is pushed toward the fixed scroll by the back pressure urging force generated from fluid introduced into a back pressure chamber formed in the rotary scroll in its portion opposing the compression chamber; and the portion between the front portion of a spiral wrap of the fixed scroll and a wrap support disc supporting the wrap of the rotary scroll is sealed.

The second invention is characterized in that: compressed fluid in a compressed chamber in the final compression stroke is introduced into the back side of a thrust bearing which supports a rotary scroll and the thrust bearing is supported by the back pressure urging force.

The third invention is characterized in that: a space present on the back side of a thrust bearing which supports a rotary scroll and a compression chamber at the final compression stroke are allowed to communicate with each other; the thrust bearing is supported by the back pressure urging force of compressed fluid introduced from a compression chamber; and a throttle path is formed at an intermediate position of a communication path.

BEST MODE FOR CARRYING OUT THE INVENTION

A first embodiment of a scroll refrigerant compressor of the present invention will now be described with reference to FIGS. 4 to 19.

Figure 1:
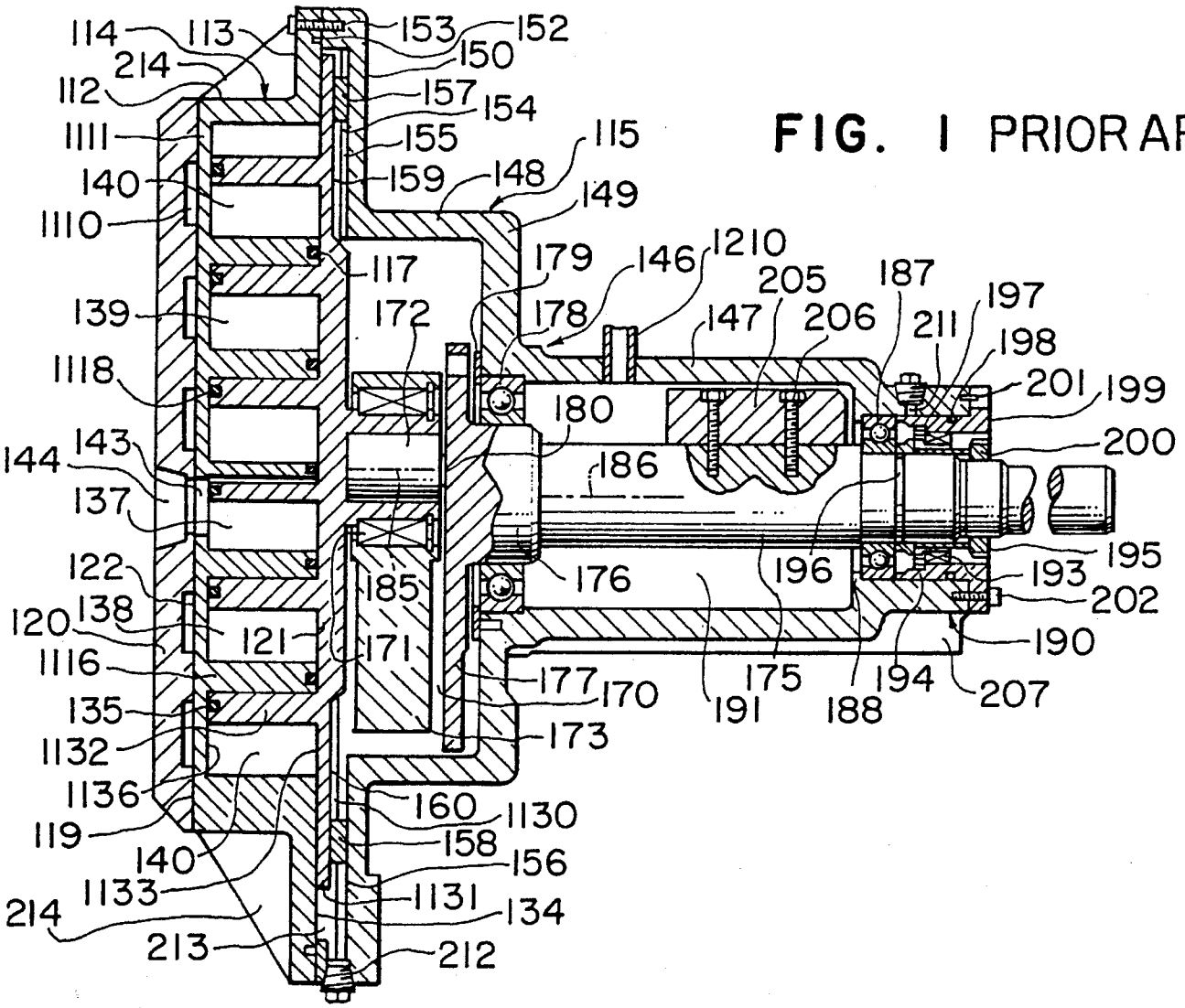
FIG. 1 PRIOR ART
FIG. 1 is a vertical cross sectional view which illustrates a conventional scroll compressor.
Figure 2:
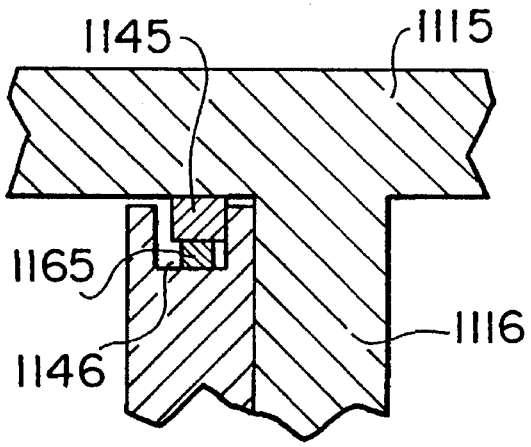
FIG. 2 PRIOR ART
FIGS. 2 and 3 are respectively partial cross sectional views which illustrate the sealed portion of the compression chamber shown in FIG. 1.
Figure 3:
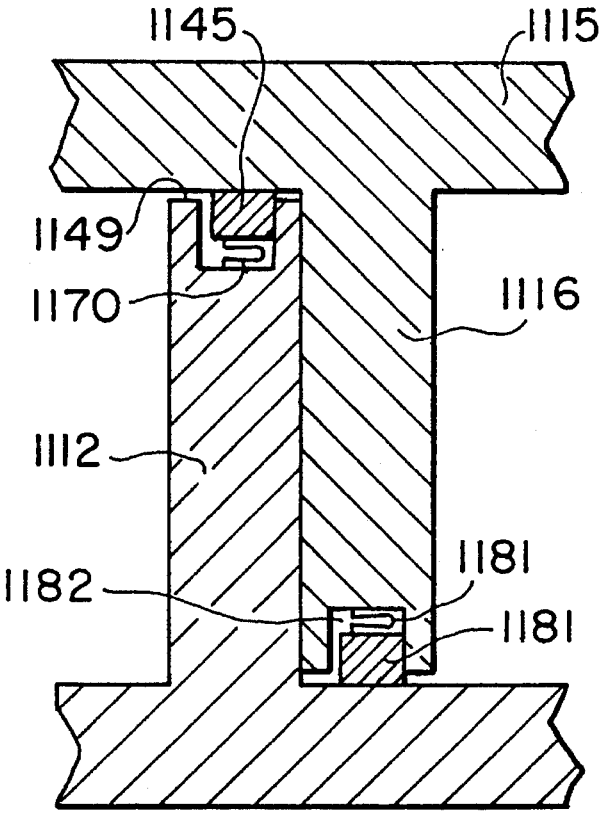
FIG. 3 PRIOR ART
Figure 4:
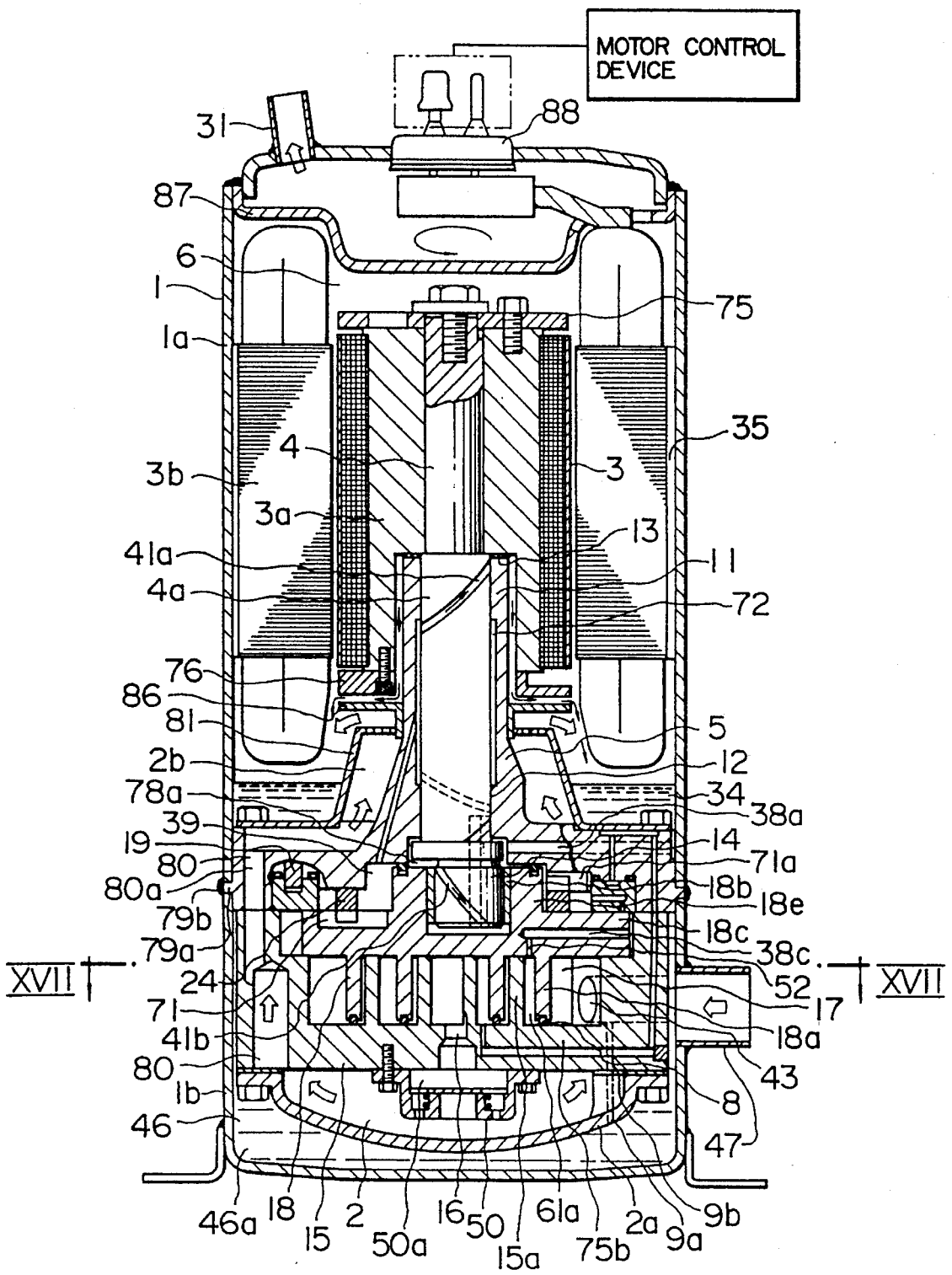
FIG. 4 is a vertical cross sectional view which illustrates an embodiment of a scroll refrigerant compressor according to the present invention.
Figure 5:
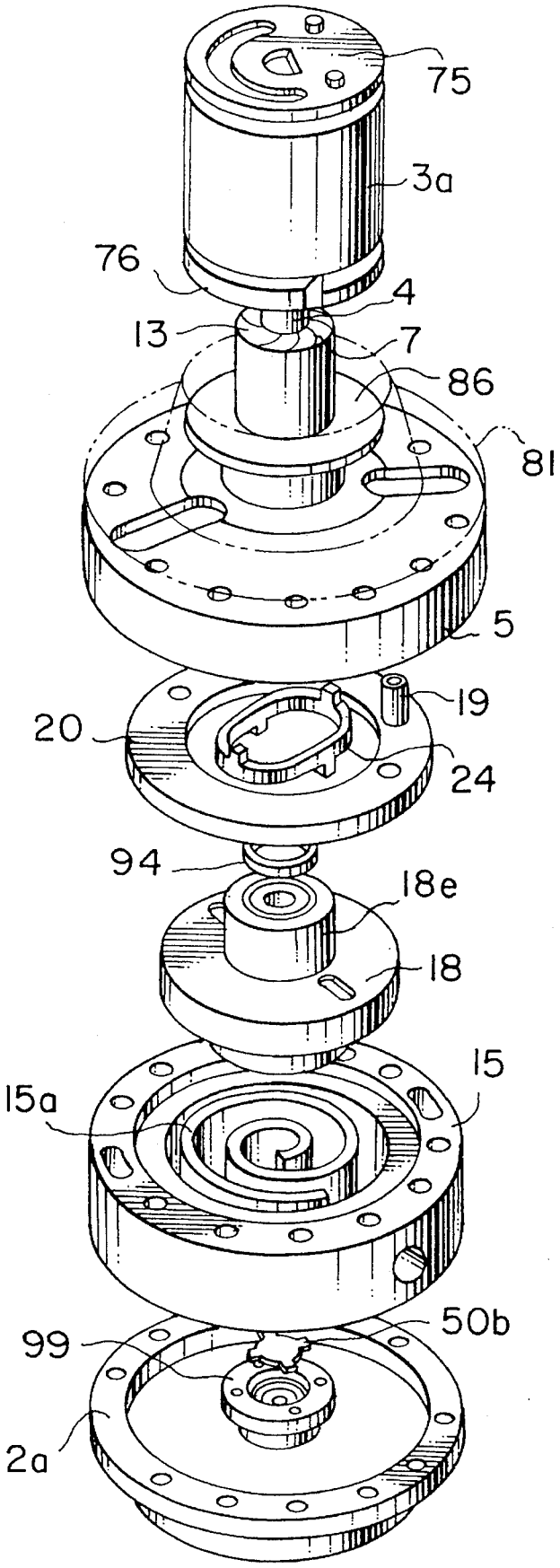
FIG. 5 is an exploded view which illustrates essential parts of the compressor.

Referring to FIG. 4, reference numeral 1 represents a sealing case which is made of iron and the inner portion of which is sectioned into an upper motor chamber 6 and a lower accumulator chamber 46 by a body frame 5 which secures, by means of a bolt, a fixed scroll portion 15 to be engaged with a rotary scroll 18 to form a compression chamber and which supports a drive shaft 4.

The motor chamber 6, arranged to be under a high pressure atmosphere, has a motor 3 which is disposed in the upper portion thereof and which is controlled by DC power in such a manner that its rotational speed is varied, and a compression portion formed in the lower portion thereof. The body frame 5 supporting the drive shaft 4, to which a rotor 3*a* of the motor 3 is connected and fixed, is made of eutectic graphite cast iron exhibiting an excellent sliding characteristic and weldability. A projecting portion 79*a* formed on the outer surface of the body frame 5 is positioned in contact with the inner surface and the end surface of each of an upper sealing case 1*a* and a lower sealing case 1*b*. The projecting portion 79*a*, the upper sealing case 1*a* ant the lower sealing case 1*b* are hermetically welded to each other by a common weld bead 79*b*.

The drive shaft 4 is supported by a main bearing 12, which is disposed et the central portion of an upper bearing 11 disposed on the top surface of the body frame 5, and a thrust bearing portion 13 which is formed on the top surface of the body frame 5 and has a plurality of shallow grooves diagonally formed on the same. A crank shaft 14 disposed at the lower end portion of the drive shaft 4 in such a manner that it is positioned eccentrically from the axis of the drive shaft 4 is engaged with a rotary bearing 18*b* of a rotary boss portion 18*e* formed in a rotary scroll 18.

Figure 17:
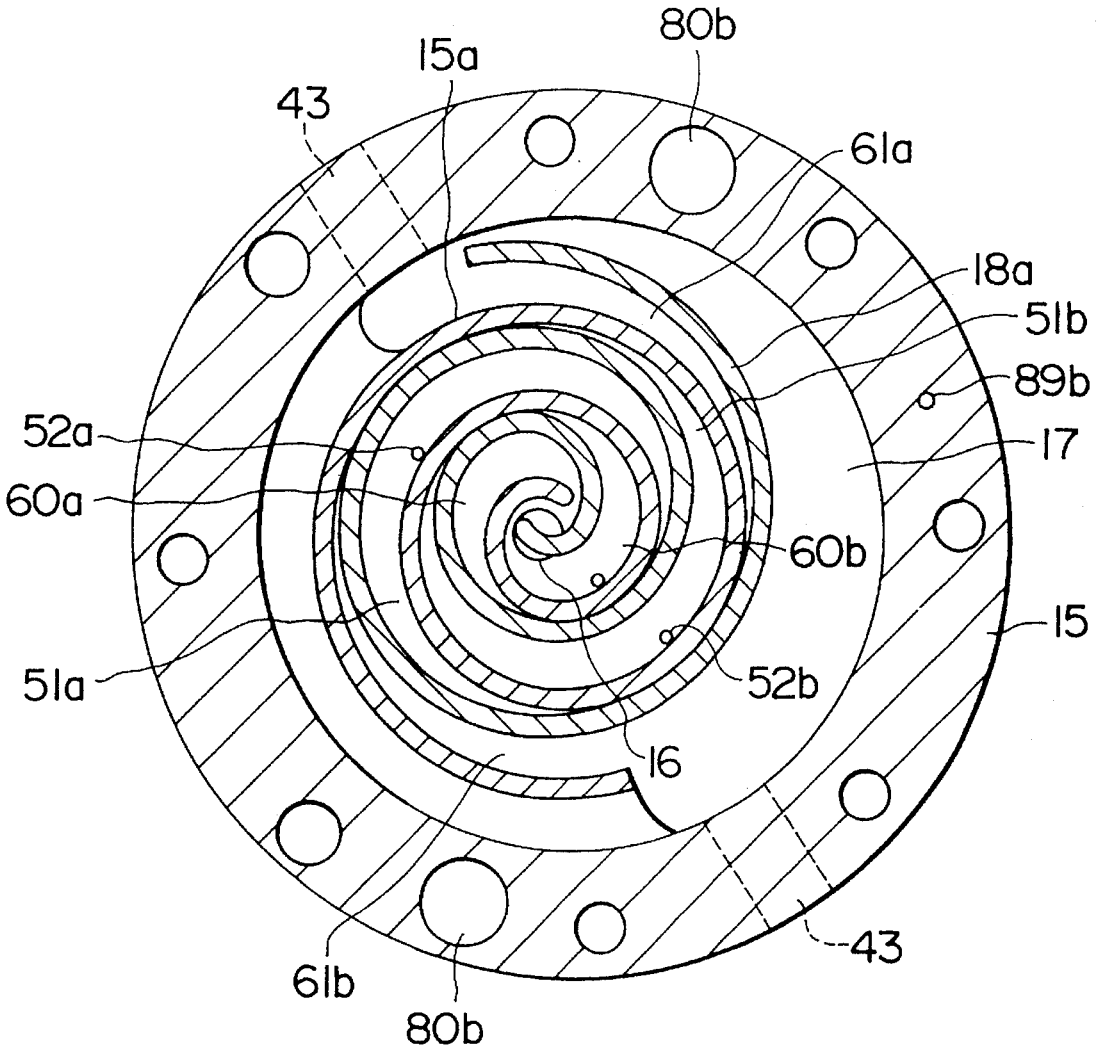
FIG. 17 is a lateral cross sectional view taken along line XVII—XVII of FIG. 4.

A fixed scroll 15 is composed of a fixed scroll wrap 15*a*, which is made of a high silicon-aluminum alloy, the coefficient of thermal expansion of which is an intermediate value between that of pure aluminum and that of eutectic graphite cast iron and which is formed into a spiral shape as shown in FIG. 17 and an end plate 15*b*. At the central portion of the end plate 15*b*, a discharge port 16, which opens at the position at which the spiral of the fixed scroll wrap 15*a* is commenced, is formed in such a manner that it is allowed to communicate with a discharge path 80 which opens in the motor chamber 6. Furthermore, a suction chamber 17 is formed on the outer surface of the fixed scroll wrap 15*a*.

A check valve unit 50 is fastened to the end plate 15 on the side opposing the rotary scroll, the check valve unit 50 comprising, as shown in detail in FIGS. 6 to 9, a valve body 50*b* (or a valve body 50*e* having a discontinuous annular hole 50*ea*) made of a thin steel plate formed by cutting a plurality of the outer portion thereof, a valve case 99 having a check valve hole 50*a*, a central hole 50*g* and a plurality of discharge apertures 50*h* formed around the central hole 50*g* and a spring unit 50*c* disposed between the valve body 50*b* and the valve case 99. The spring unit 50*c* has a shape memory characteristic with which it is contracted when its temperature exceeds 50° C. and it is elongated when the same is lowered to below 50° C. Therefore, during the operation of the compressor, the spring unit 50*c* is contracted to the bottom surface of the check valve hole 50*a* due to the effect of the pressure of the discharged gas and the shape memory characteristic displayed when the temperature exceeds 50° C. On the other hand, when the operation of the compressor is stopped, the spring unit 50*c* presses the valve body 50 against the end plate 15*b* to close the discharge portion when the temperature is 50° C. or lower.

As shown in FIGS. 4 and 17, the spiral rotary scroll wrap 18*a*, which is engaged with the fixed scroll wrap 15*a* to form the compression chamber and the aluminum alloy rotary scroll 18 on which the rotary boss portion 81*e*, which is engaged with the crank shaft 14 of the drive shaft 4, is stood erect, are surrounded by the fixed scroll 15 and the body frame 5. The surface of a wrap support disc 18*c* and that of the rotary scroll wrap 18*a* are respectively subjected to a hardening treatment such as porous nickel plating. A spiral tip seal groove 98 as disclosed in U.S. Pat. No. 3,994,636 is formed at the leading portion of the rotary scroll wrap 18*a*, the tip seal groove 98 having resin tip seals 98*a* fitted at small intervals secured therebetween.

When the rotary scroll 18 is pressed in the axial direction of the fixed scroll 15, the flat portion of the wrap support disk 18*c* comes in contact with the leading portion of the fixed scroll wrap 15*a*. However, the leading portion of the rotary scroll wrap 18*a* does not come in contact with the fixed scroll 15 while leaving several microns, the gap thus-formed being sealed by the tip seal 98*a*.

The discharge path 80 comprises: a discharge chamber 2 formed by a discharge cover 2*a*, which is fastened to the end plate 15*b* to cover the check valve unit 50, and the mirror plate 15*b*; a gas path 80*b* formed in the fixed scroll 15; a gas path 80*a* formed in the main frame 5; and a discharge chamber 2*b* formed by a discharge guide 81 fastened to the body frame 5 to cover the main bearing 12 and the body frame 5. The gas path 80*a* and the gas path 80*b* are respectively further symmetrically disposed (see FIG. 17).

A multiplicity of apertures 81*a* are formed on the upper surface of the discharge guide 81 in such a manner that they are equally spaced symmetrically.

The accumulator chamber 46 allowed to communicate with the portion adjacent to an evaporator of the refrigerating cycle is constituted by a lower sealing case 1*b*, the fixed scroll 15 and the body frame 5. A suction pipe 47 allowed to communicate with the accumulator chamber 46 is disposed on the side surface of the lower sealed case 16. Furthermore, suction holes 43 are formed in the two portions of the fixed scroll 15, that is, at the position confronting the suction pipe 47 and positions respectively away from the above-described position by an angular degree of about 90°.

A low-pressure oil reservoir 46*a* formed at the bottom portion of the accumulator chamber 46 and the suction hole 43 are allowed to communicate with each other by means of an oil suction hole 9*a* formed in the discharge cover 2*a* and an oil suction hole 9*b* formed in the fixed scroll 15 and having a small diameter. The above-described oil suction holes (9*a*, 9*b*) are arranged to be capable of sucking refrigerant liquid or lubricating oil left in the low pressure oil reservoir 46*a* by utilizing negative pressure which can be generated when the refrigerant gas passes through the suction hole 43.

A thrust bearing 20 formed into a flat plate, the rotational directional movement of which is restricted by a parallel pin 19 in the form of a split cotter pin and only the axial directional movement of which is permitted, is disposed between the wrap support disc 18*c* and the body frame 5, the thrust bearing 20 being brought into contact with an end plate fastening surface 15*b*1 disposed between the body frame 5 and the fixed scroll 15 by elastic force of an annular seal ring 70 (made of rubber) disposed between the thrust bearing 20 and the body frame 5.

The height from an end plate sliding surface 15*b*2, which slides on the wrap support disc 18*c* of the rotary scroll 18, to the end plate fastening surface 15*b*1 is arranged to be a value which is larger than the thickness of the wrap support disc 18*c* by about 0.015 to 0.20 mm in order to improve the sealing effect obtained by means of the oil film in the sliding portion.

Figure 12:
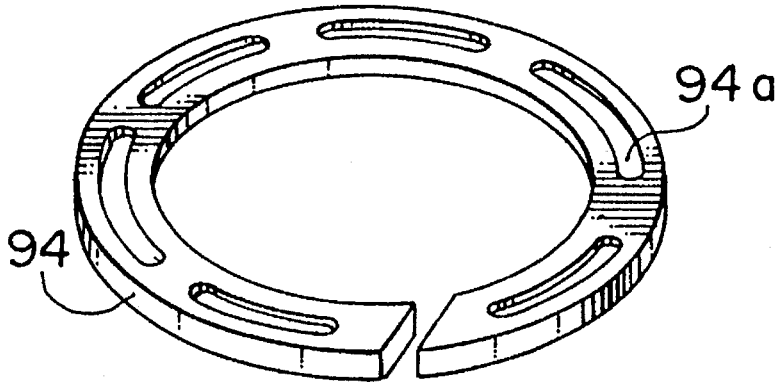
FIG. 12 is a perspective view which illustrates seal parts of the compressor.

An annular sealing groove 95, which is coaxially disposed with the central portion of the rotary bearing 18*b*, is formed in the rotary boss portion 18*e* of the rotary scroll 18 on the surface adjacent to the body frame 5. An annular ring 94, which is made of teflon possessing flexibility and from which a portion is cut as shown in FIG. 12, is fitted to the above-described annular sealing groove 95 in such a manner that the outer surface of the annular ring 94 is positioned in contact with the side surface of the annular sealing groove 95. The annular ring 94 seals a portion between a back pressure chamber 39 of the rotary scroll 18 formed by the rotary scroll 18, the body frame 5 and the thrust bearing 20 and the main bearing 12 which supports the drive shaft 4.

Figure 13:
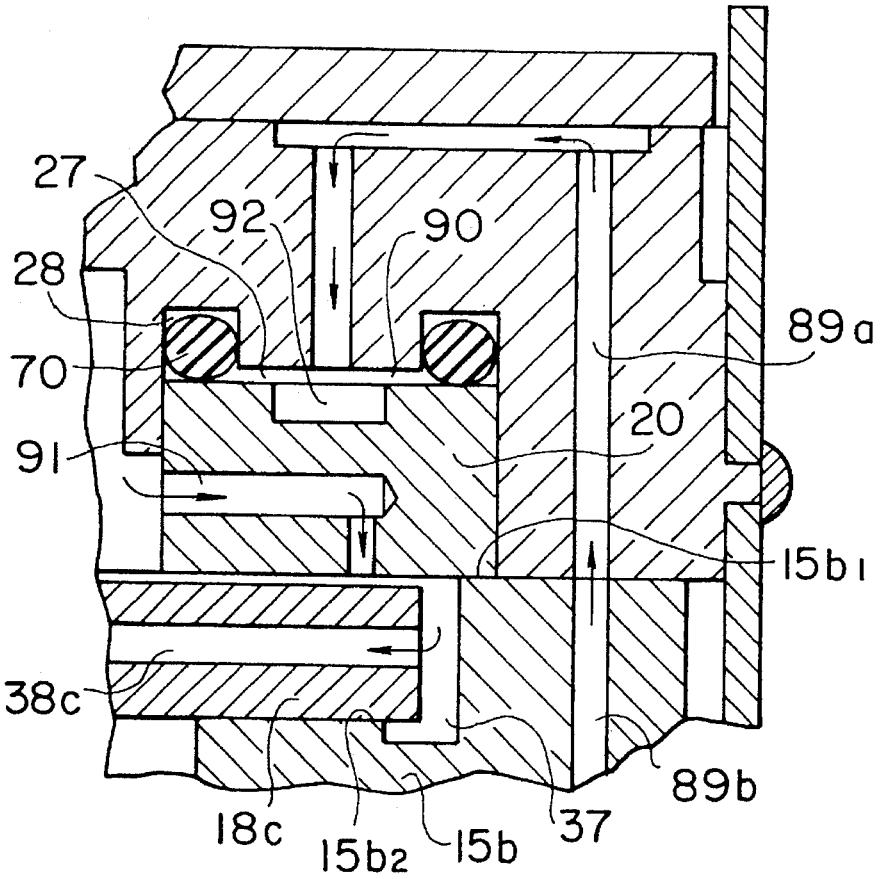
FIG. 13 is a partial cross sectional view which illustrates a thrust bearing portion of the compressor.
Figure 14:
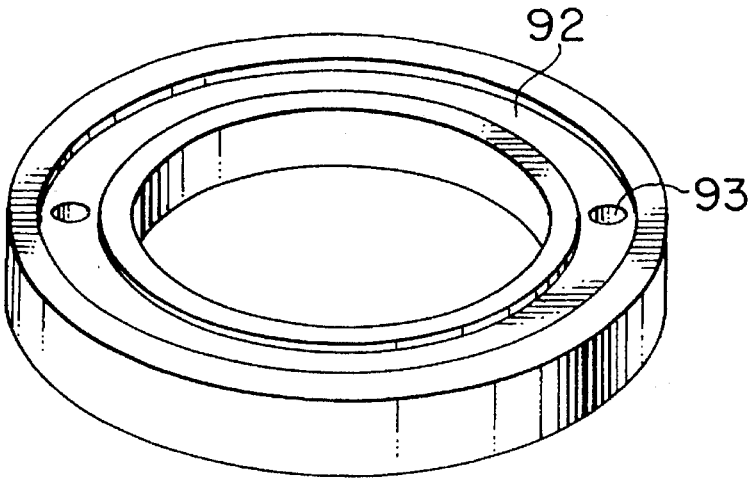
FIG. 14 is a perspective view which illustrates the thrust bearing shown in FIG. 13.

The annular thrust bearing 20 is made of a sintered alloy, in which through holes can easily be formed, the annular thrust bearing 20 having, as shown in FIGS. 13 and 14, two guide holes 93 in which split cotter pins 19 are movably inserted, an annular oil groove 92 and an oil hole 91. The annular thrust bearing 20 is fitted within a thrust ring groove 90 formed in the body frame 5.

A release gap 27, the size of which is about 0.05 mm, is formed between the body frame 5 and the thrust bearing 20. An annular groove 28 for receiving a seal ring 70 is formed on the inner and outer sides of the release gap 27. The seal ring 70 seals the portion between the release gap 27 and the back pressure chamber 39.

The release gap 27 is allowed to communicate with a third compression chamber 60 serving as the final compression stroke by means of a thrust back pressure introduction hole 89*a* formed in the body frame 5 and a thrust back pressure introduction hole 89*b* formed in the fixed scroll 15.

A rotation stopping member (hereinafter called an "Oldham's ring") 24 disposed on the inside of the thrust bearing 20 and acting to stop the rotation of the rotary scroll 18 is made of a light alloy or a fiber reinforced composite material which can be suitably used in the sinter-molding or the inject molding manufacturing process, the rotation stopping member 24 having parallel-key shape key portions formed on the two flat sides thereof, the two key portions being formed perpendicular to each other. The key portion formed on the upper side of the rotation stopping member 24 is engaged with the key groove 7 formed in the body frame 5, while the key portion formed on the lower side of the same is engaged with the key groove 71*a* formed in the wrap support disc 18*c*, to respectively slide.

The thickness of the Oldham's ring 24 is arranged in such a manner that it is able to smoothly slide between the body frame 5 and the wrap support disc 18*c* via oil films while preventing a jumping phenomenon when the Oldham's ring 24 performs the reciprocating motion.

A discharge pipe 31 is fastened to the outer surface of the upper end wall of the upper sealed case 1*a*, while a glass terminal 88, to which a motor power supply which is allowed to communicate with the DC inverter power supply is connected, is fastened to the central portion of the same.

The portion including the discharge pipe 31 and the glass terminal 88 and the portion including the motor 3 are separated from each other by an oil separator 87 fastened to the upper sealed case 1*a*. A rotor 3*a* axially positioned by the stepped portion of the drive shaft 4 is, together with an upper balance weight 75 formed by a punching work, fixed to the drive shaft 4 by means of a bolt. The upper balance weight 75 is formed into a disc shape, the upper balance weight 75 having a diameter which is larger than the outer diameter of the rotor 3*a* in order to efficiently centrifugally separate the lubricating oil contained in the discharged refrigerant gas.

A shielding plate 86 fastened to the body frame 5 is disposed between the lower balance weight 76 fastened to the lower end portion of the rotor 3*a* and the discharge guide 81 in such a manner that the shielding plate 86 is positioned adjacently to the lower balance weight 76.

The discharge chamber oil reservoir 34 formed in the lower portion of the motor chamber 6 is allowed to communicate with the upper portion of the motor chamber 6 by a cooling path 35 formed by cutting a portion of the outer surface of the statar 3*b* of the motor 3.

The discharge chamber oil reservoir 34 is also allowed to communicate with an oil chamber 78 positioned at an intermediate position between the main bearing 12 and the rotary bearing 18*b* via an oil hole 38*a* formed in the body frame 5.

Spiral oil grooves 41*a* and 41*b* are respectively formed on the surface of a sliding shaft portion 4*a* of the drive shaft 4 and that of the crank shaft 14 in a direction in which lubricating oil in the oil chamber 78*a* is, in a screw-pump manner, supplied to an oil chamber 78*b* formed by the rotary bearing 18*b*and the crank shaft 14 and to the portion including the motor 3 when the drive shaft 4 is forward rotated, the leading portions of the spiral oil grooves 41*a* and 41*b* being arranged to reach the thrust bearing 13.

The oil chamber 78*b* and the surface of the main bearing 12 are allowed to communicate with each other by an oil supply hole 73*a* formed in the drive shaft 4. An oil reservoir 72 formed between the upper bearing 11 and the main bearing 12 and the back pressure chamber 39 are allowed to communicate with each other by an oil hole 38*b* formed in the body frame 5 and having a throttle path portion. The end portion of the opening of the oil hole 38*b* adjacent to the back pressure chamber 39 is positioned at a position which is intermittently opened/closed when the annular ring 94 rotates together with the rotary scroll 18. A second compression chamber 51 and the back pressure chamber 39, which are intermittently allowed to communicate with the suction chamber 17, are allowed to communicate with each other by the oil hole 91, an outer space 37 of the wrap support disc 18*c*, an oil hole 38*c* formed in the wrap support disc 18*c* and an injection passage 74 constituted by an injection hole 52 having a small diameter. The hole hole 91 formed in the thrust bearing 20 and the lower stream of the oil hole 91 are intermittently opened/closed by the wrap support disc 18*c*.

Figure 15:
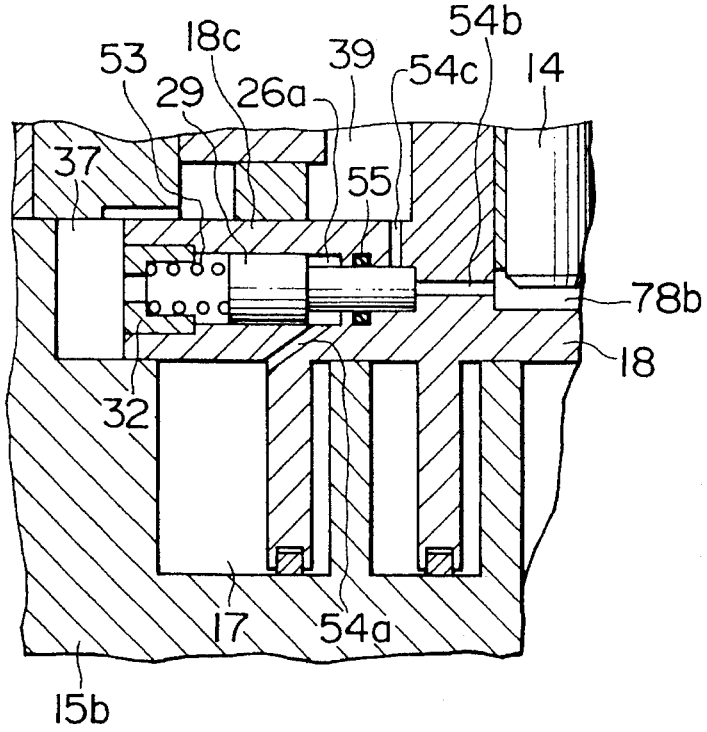
FIGS. 15 and 16 are respectively cross sectional views which illustrate the operation of a back pressure control valve unit of the compressor.
Figure 16:
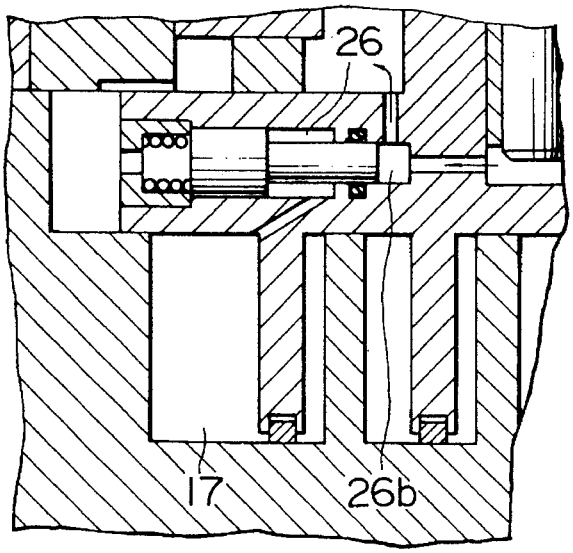

As shown in FIGS. 15 and 16, a back pressure control valve unit 25 for controlling the pressure of the back pressure chamber 39 is fastened to the wrap support disc 18*c*.

The back pressure control valve unit 25 is constituted by a stepped-shape cylinder 26 composed of a large-diameter cylinder 26*a* and a small-diameter cylinder 26*b* and disposed in the radial direction of the wrap support disc 18*c*, a stepped-shape plunger 29 which is movable in the above-described cylinder, a cap 32 for covering a portion of an opening formed in the cylinder 26 adjacent to the outer space 37, a coil spring 53 disposed between the cap 32 and the plunger 29 and urging the plunger 29 toward the crank shaft 14, an oil hole 54*a* for establishing a communication between the portion of the large-diameter cylinder 26*a* adjacent to the crank shaft 14 and the suction chamber 17 and oil holes 54*b* and 54*c* for establishing communication between the portion of the small-diameter cylinder 26*b* adjacent to the crank shaft 14 and the oil chamber 78*b* and the back pressure chamber 39. The operation is arranged in such a manner that, when the pressure of the back pressure chamber 39 is in a proper pressure range, the small-diameter end surface of the plunger 29 closes the end portion of the opening of the oil hole 54*b* adjacent to the cylinder. When the pressure of the back pressure chamber 39 is insufficient, the plunger 29 is moved toward the outer space 37 due to the difference in the urging force acting to the two sides of the plunger 29 while making the large diameter portion of the plunger 29 to be the boundary. As a result, the end portion of the opening of the oil hole 54*b* adjacent to the cylinder is opened, causing the oil chamber 78*b* and the back pressure chamber 39 to be allowed to communicate with each other. In order to realize the above-described operation, the urging force of the coil spring 53 and the dimensions of the cylinder are established.

Reference numeral 55 represents an O-ring fastened to the small-diameter cylinder 26*b* for the purpose of sealing the outer surface of the small-diameter portion of the plunger 29.

Figure 18:
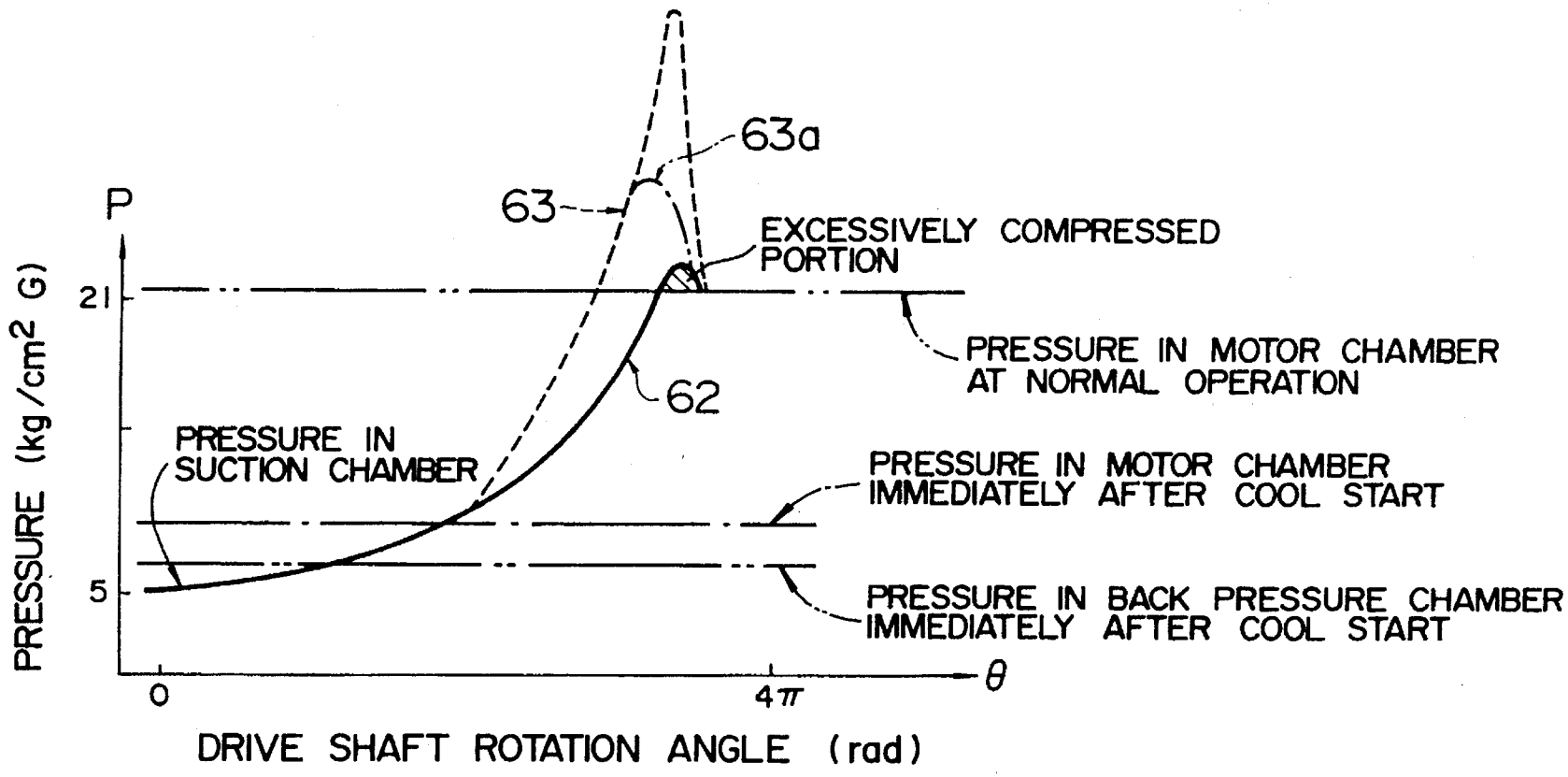
FIG. 18 is a characteristic graph which illustrates the pressure change of a refrigerant gas from a suction stroke to a discharge stroke of the compressor.

Referring to FIG. 18, the axis of the abscissa stands for the rotational angle of the drive shaft 4, while the axis of ordinate stands for the pressure of the refrigerant so that it shows the change in the pressure of the refrigerant gas in the suction, the compression and the discharge processes, where a continuous line 62 designates the change in the pressure at the time of the operation with normal pressure and a dashed line designates the change in the pressure at the time of the abnormal rise of the pressure.

Figure 19:
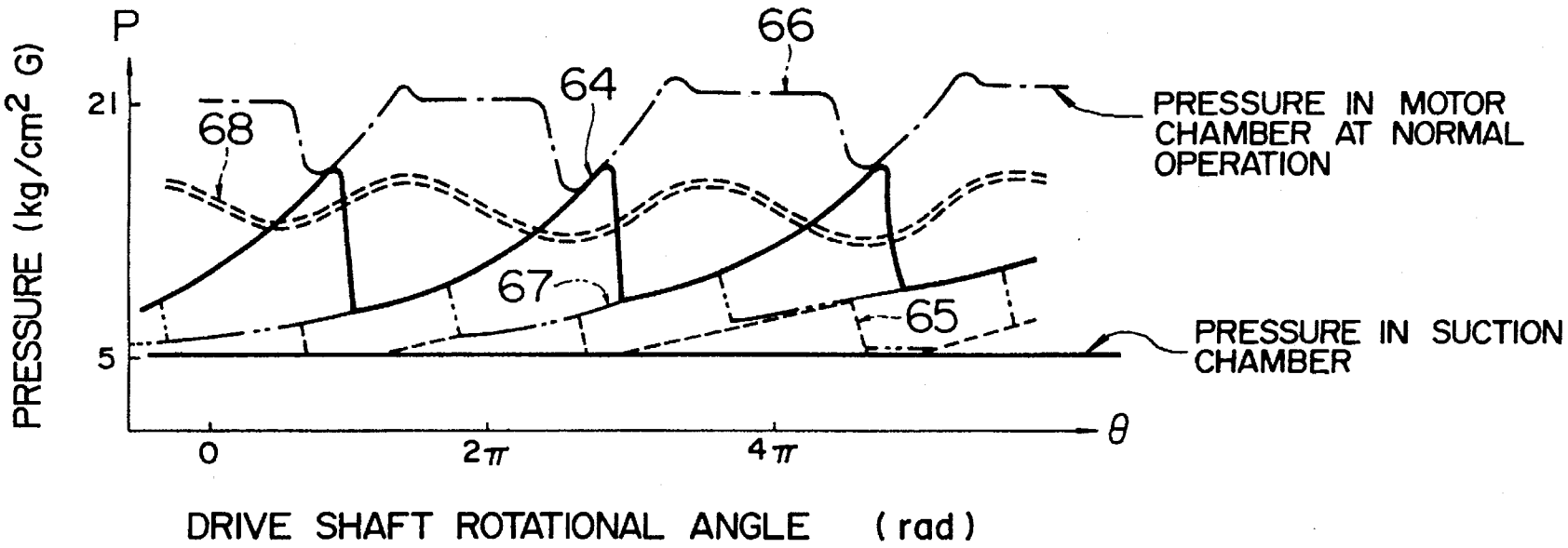
FIG. 19 is a characteristic graph which illustrates the pressure change at a fixed point in each compression chamber.

Referring to FIG. 19, the axis of abscissa stands for the rotational angle of the drive shaft 4 and the axis of ordinate stands for the pressure of the refrigerant, where a continuous line 64 designates the change in the pressure at the openings of the injection holes 52*a* and 52*b* of second compression chambers 51*a* and 51*b* which are not allowed to communicate with the discharge chamber 2 and the suction chamber 17 and a dashed line 65 designates the change in the pressure at fixed points of first compression chambers 61*a* and 61*b* (see FIG. 10) which are allowed to communicate with the suction chamber 17, where line 67 with an alternate long and two short dashes line designates the change in the pressure at fixed points between the first compression chambers 61*a* and 61*b* and the second compression chambers 51*a* and 51*b* and double dashed line designates the change in the pressure of the back pressure chamber 39.

Figure 20:
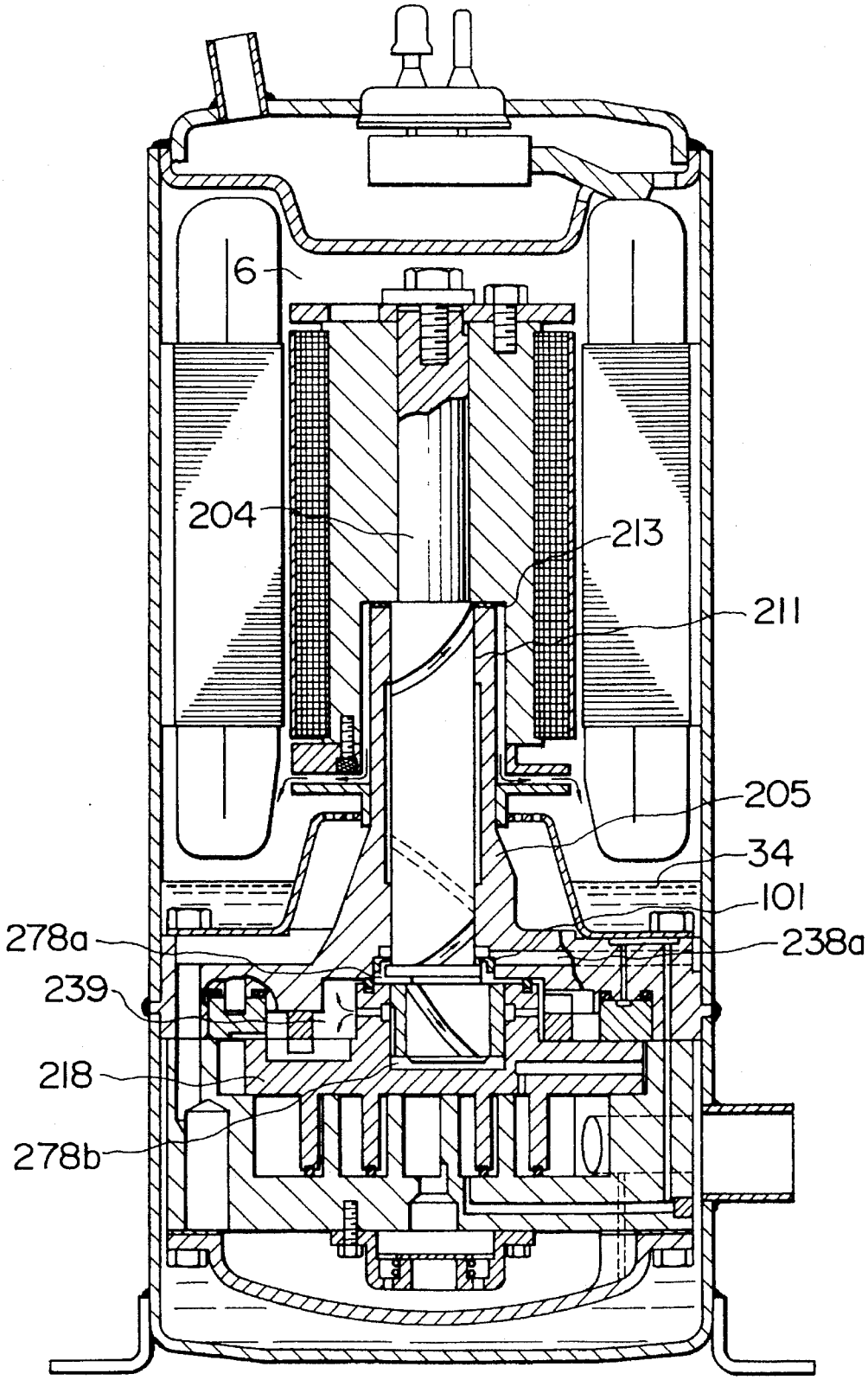
FIG. 20 is a vertical cross sectional view which illustrates a second embodiment of the scroll refrigerant compressor according to the present invention.
Figure 21:
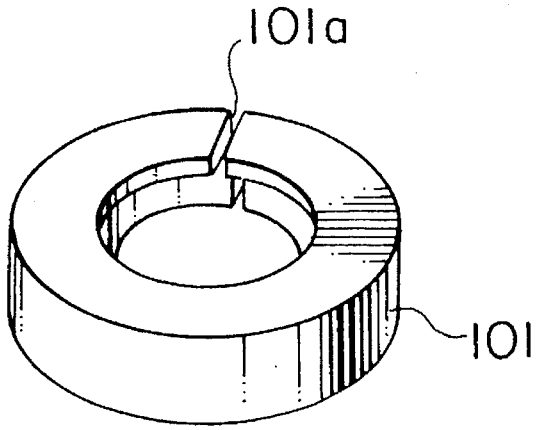
FIGS. 21 and 22 are respectively perspective views which illustrate a partition cap and bearing elements of the compressor.
Figure 23:
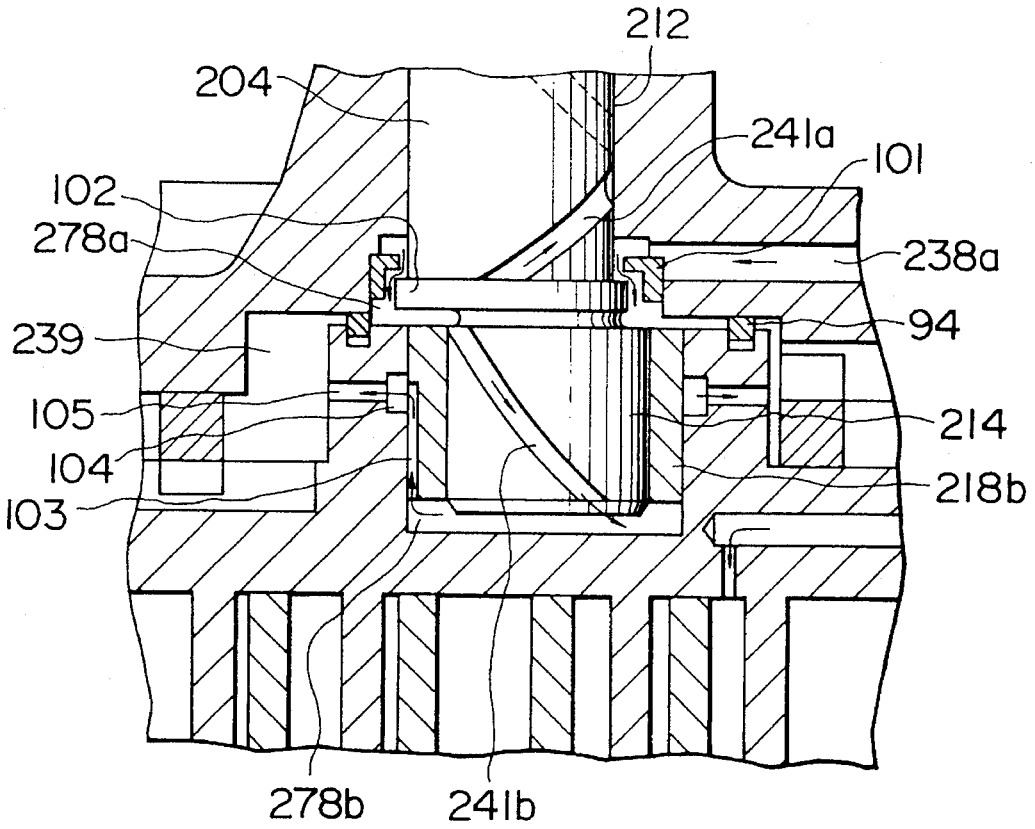
FIG. 23 is a partial cross sectional view which illustrates a main bearing portion of the compressor.

FIG. 20 is a vertical cross sectional view which illustrates a second embodiment of the scroll refrigerant compressor according to the present invention. A partition cap 101 formed into a shape shown in FIG. 21 and made by forming a steel plate is press-fit into a stepped inner wall of a high pressure oil hole 278*a* allowed to communicate with the discharge chamber oil reservoir 34 via an oil hole 238*a* formed in a body frame 205, the partition cap 101 being disposed to cover a flange portion 102 of a drive shaft 204 as shown in FIG. 23. The partition cap 101 has a cut portion 101*a* formed in a portion thereof and partitions the oil chamber 278*a* into a portion adjacent to the main bearing 212 and a portion adjacent to the rotary bearing 218*b*in such a manner that it closes the cut portion 101*a* while being fastened to the stepped inner wall of the oil chamber 278*a*.

Figure 22:
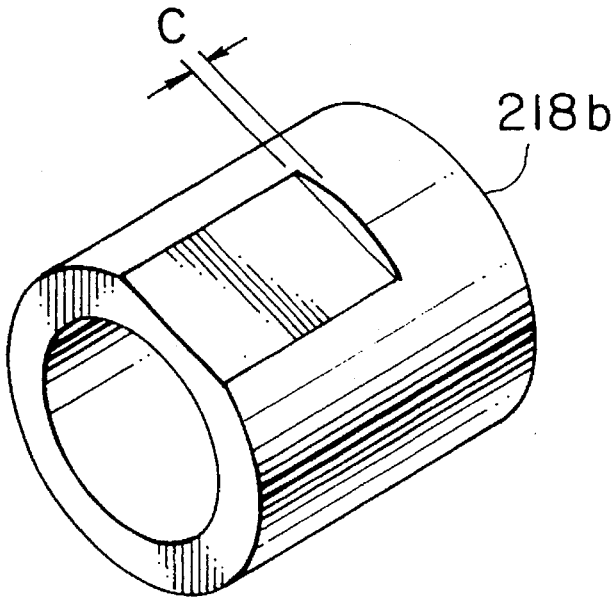

A rotary bearing 218, the outer shape of which is arranged to be as shown in FIG. 22, is press-fit into a rotary boss portion 218*e* of a rotary scroll 218. The rotary bearing 218 formed into a cylindrical shape has an outer surface a portion of which is subjected to a flattening work to nave step C of about 100 microns. The portion of the step C forms a throttle path 103 when press-fit into the rotary boss portion 218*e* as shown in FIG. 23.

The rotary boss portion 218*e* has an annular groove 104 and an oil hole 105 having a small diameter.

The discharge chamber oil reservoir 34 and a back pressure chamber 239 are allowed to communicate with each other via the oil hole 238*a*, the oil chamber A 278*a*, a spiral oil groove 241*b*, an oil chamber 278*b*, the throttle path 103, the annular groove 104 and the oil hole 105.

Figure 24:
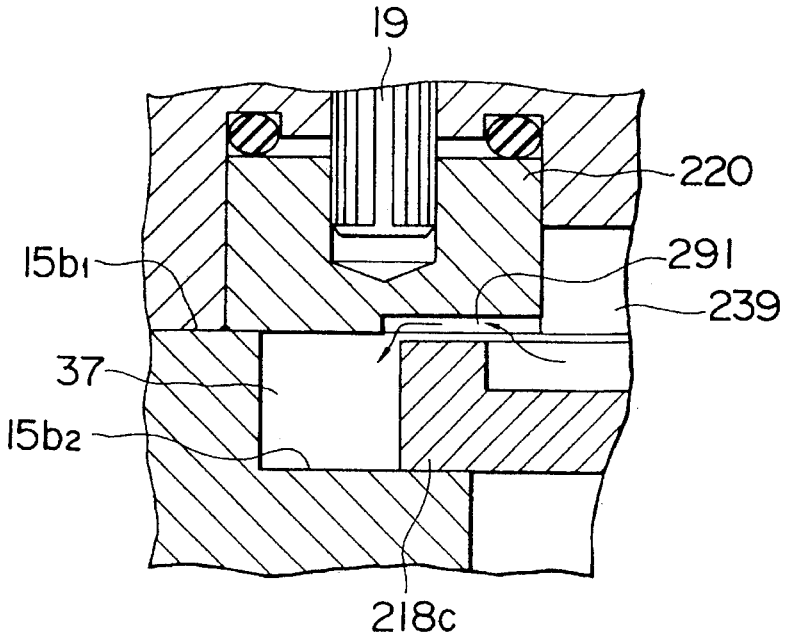
FIG. 24 is a partial cross sectional view which illustrates a thrust bearing portion of the compressor.

As shown in FIG. 24, the position of a shallow groove 239 is established in such a manner that the outer space 37 and the back pressure chamber 239 are allowed to communicate with each other via a shallow groove 239 formed in the surface of a thrust bearing 219 only when the compression chamber is at the rotary angle of the suction stroke and they are cut off by a wrap support disc 218*c* of the rotary scroll 218 When the compression chamber is at the rotary angle of the compression stroke.

The other structures are the same as those shown in FIG. 4.

Figure 25:
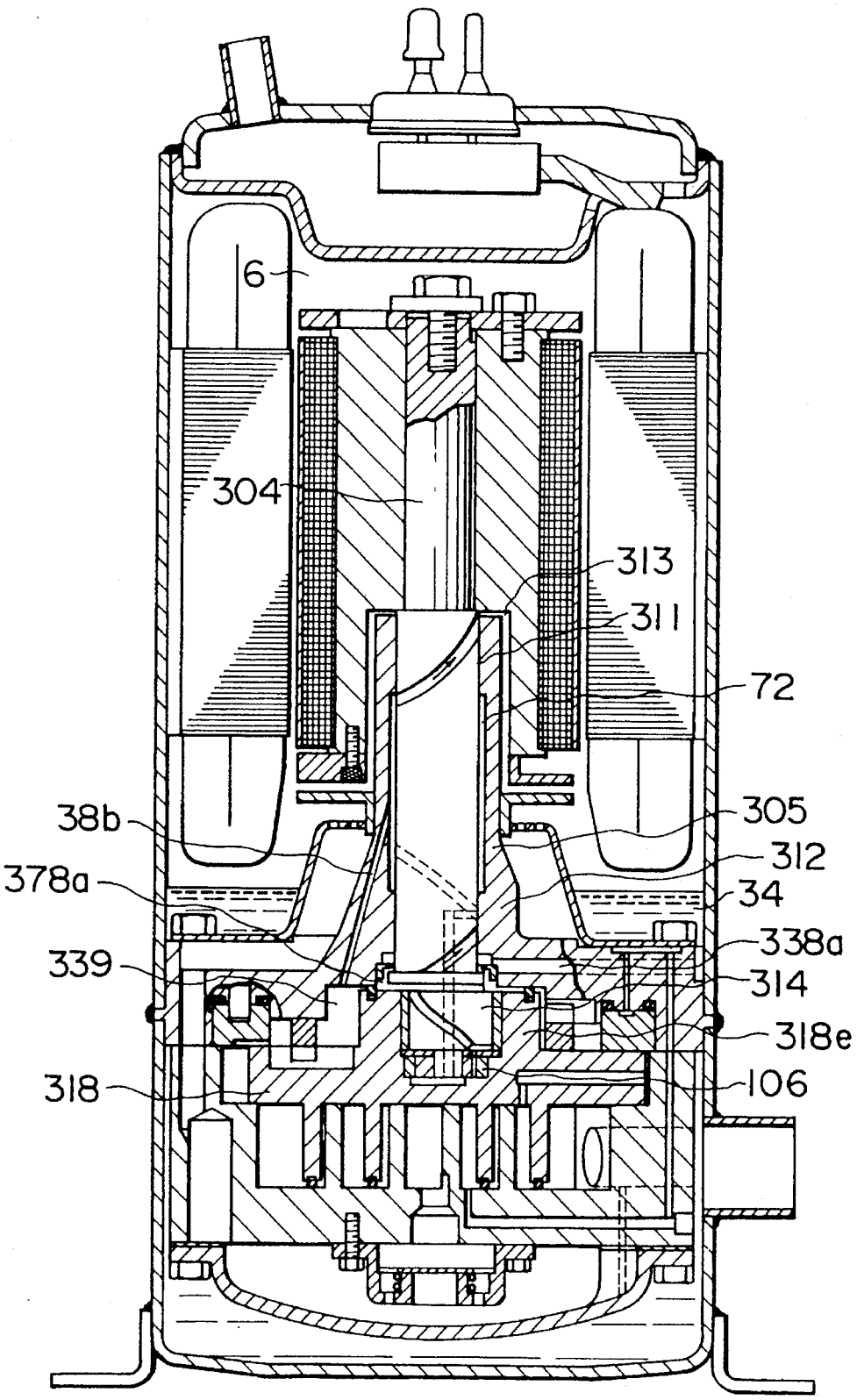
FIG. 25 is a vertical cross sectional view which illustrates a third embodiment of the scroll refrigerant compressor according to the present invention.
Figure 26:
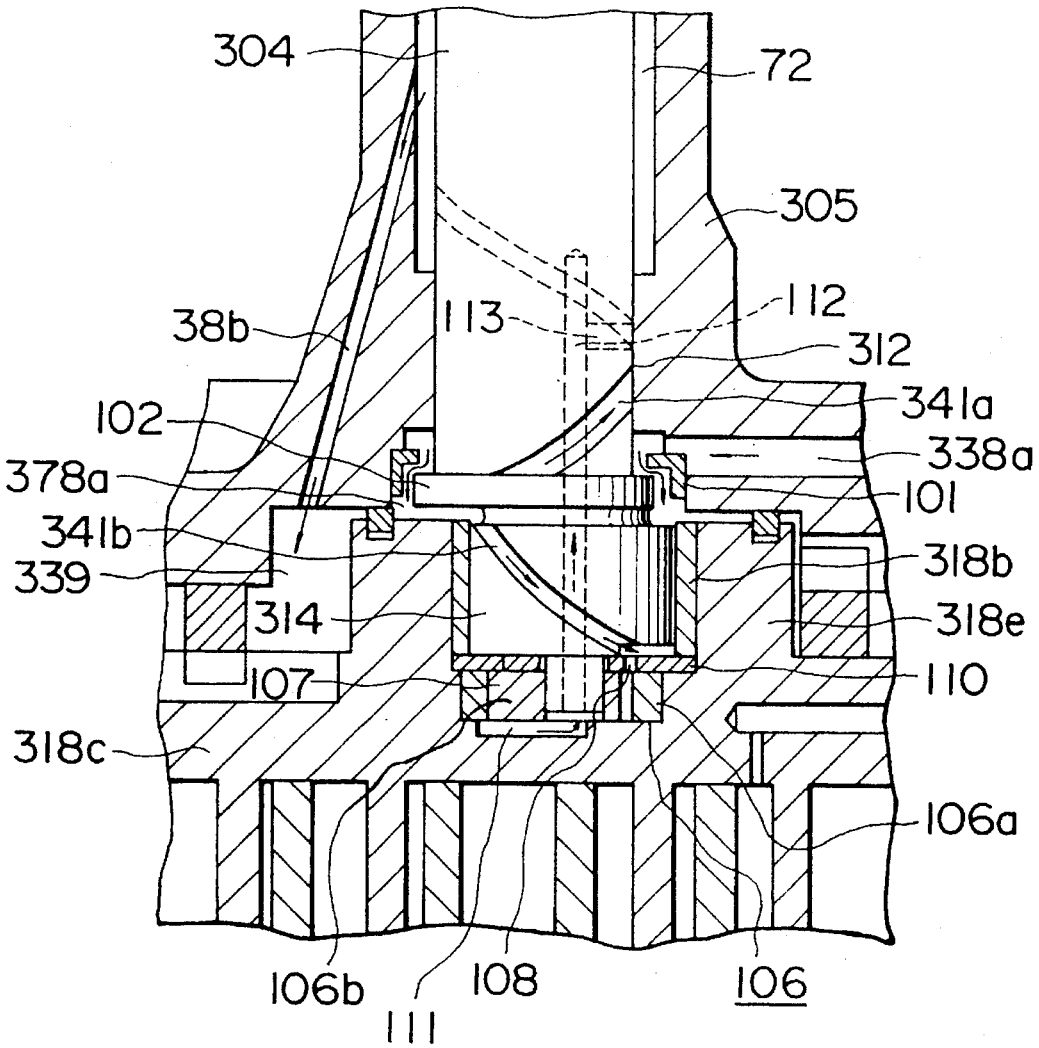
FIG. 26 is a partial cross sectional view which illustrates a main bearing portion of the compressor.

FIG. 25 is a vertical cross sectional view which illustrates a third embodiment of the scroll refrigerator compressor according to the present invention. Similarly to the case shown in FIG. 20, the partition cap 101 made by forming a steel plate is, as shown in FIG. 26, press-fit into a stepped inner wall of a high pressure oil hole 378*a* allowed to communicate with the discharge chamber oil reservoir 34 via an oil hole 338*a* formed in a body frame 305, the partition Cap 101 being disposed to cover the flange portion 102 of a drive shaft 304 similarly to the case shown in FIG. 23. As a result, the oil chamber 378*a* is partitioned into a main bearing portion 312 and a rotary bearing portion 318*b*.

A rotary bearing 318 is press-fit into a rotary boss portion 318*e* of a rotary scroll 318, the bottom portion of the rotary boss portion 318*e* having a trochoid pump unit 106 fastened thereto and composed of an outer rotor 106*a* and an inner rotor 106*b*.

The trochoid pump unit 106 is connected to a drive end shaft 107 disposed at the front portion of a crank 314 disposed at an end portion of the drive shaft 304 so as to be operated. The crank shaft 314 and the drive end shaft 107 are arranged to be concentrically disposed.

Figure 27:
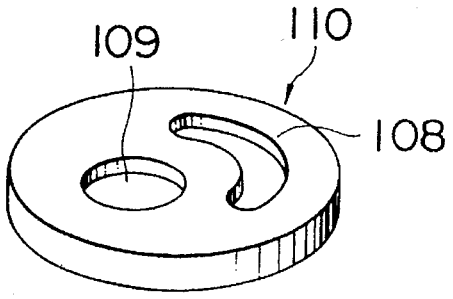
FIG. 27 is a perspective view which illustrates a partition plate for use in a trochoid pump unit shown in FIG. 26.

A partition plate 110 having a suction hole 108 and a central hole 109 formed as shown in FIG. 27 is fastened and secured to a position between the rotary bearing 318*b* and the trochoid pump unit 106.

An oil groove 111 formed in the central portion of a wrap support disc 318*c* of the rotary scroll 318 serves as a discharge port of the trochoid pump unit, the oil groove 111 and the sliding surface of a main bearing 312 being allowed to communicate with each other by an axial directional oil hole 112 and a radial directional oil hole 113 formed in the drive shaft 304.

The discharge chamber oil reservoir 34 and a back pressure chamber 339 of the rotary scroll 318 are allowed to communicate with each other through oil hole 38*b* by an oil supply path passing through the oil chamber 338*a*, the oil chamber 378*a*, the spiral oil groove 341*b*, the suction hole 108, the trochoid pump unit 106, the oil groove 111, the axial oil hole 112, the radial directional oil hole 113, a gap in the main bearing 312 and the oil reservoir 72 and another oil supply path passing through the oil chamber 378*a*, the spiral oil groove 341*a* and the oil reservoir 72.

The other structures are the same as those shown in FIG. 20.

Figure 28:
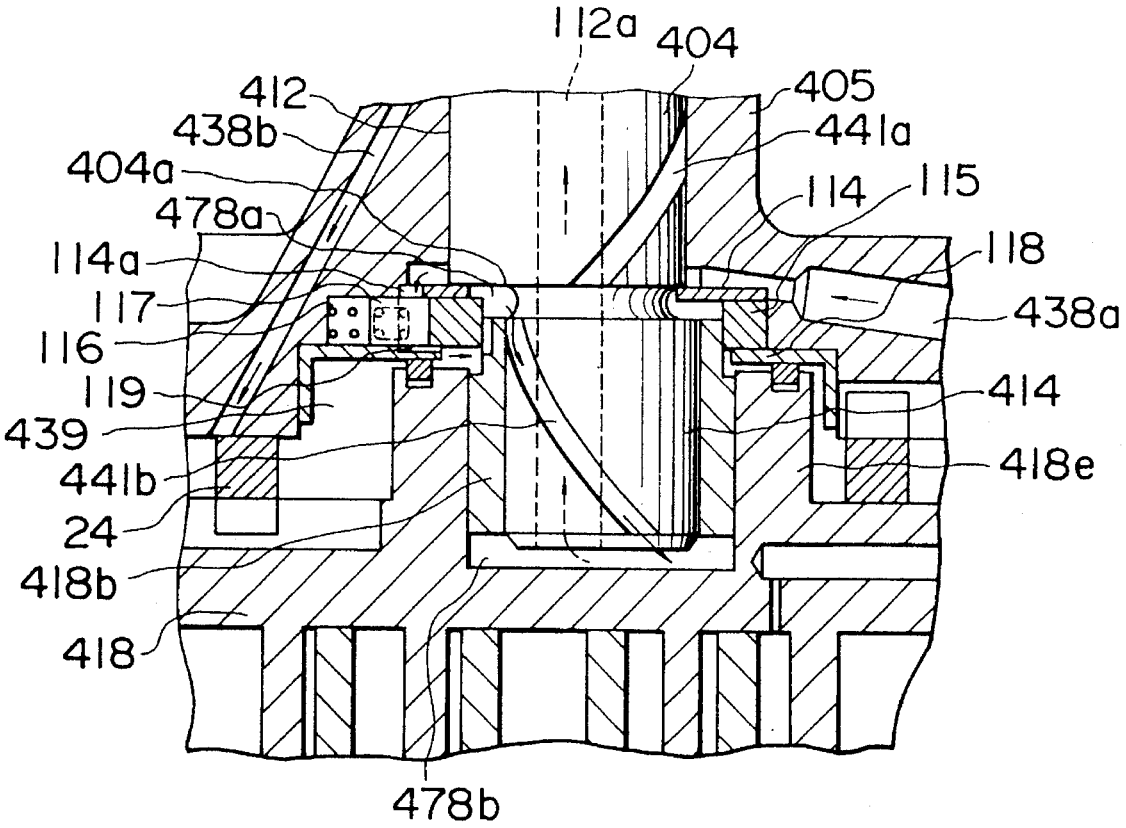
FIG. 28 is a partial cross sectional view which illustrates a main bearing portion of a fourth embodiment of the scroll refrigerant compressor according to the present invention.
Figure 30:
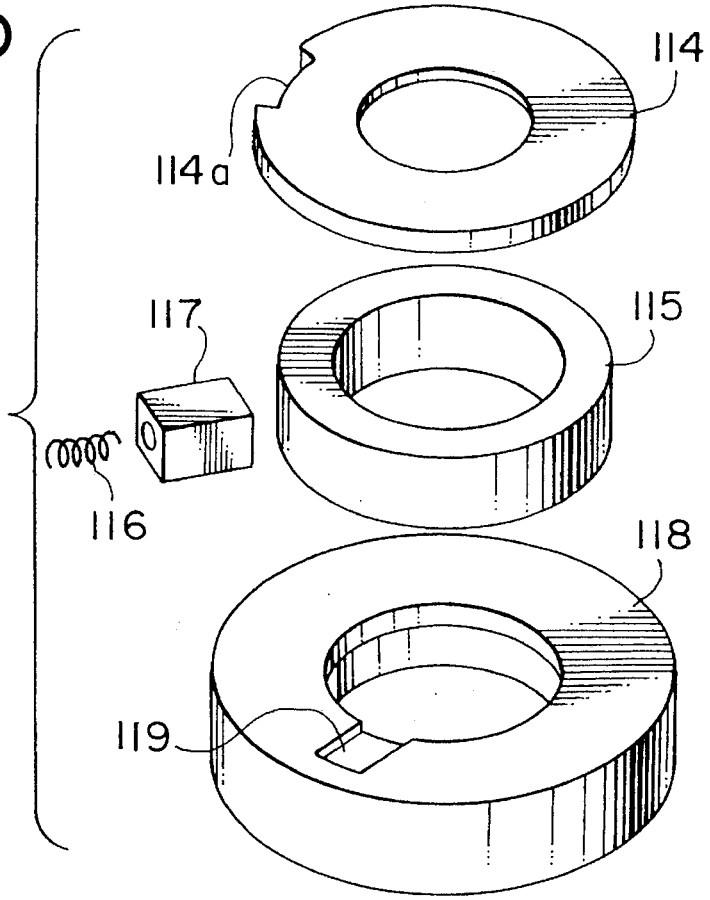
FIG. 30 is a perspective exploded view which illustrates elements of an oil supply pump unit of the compressor.

FIG. 28 is a vertical cross sectional view which illustrates a portion including the oil supply pump unit disposed at the front portion of the drive shaft of a fourth embodiment of the scroll refrigerant compressor according to the present invention. A side plate 114 having a suction cut portion 114*a*, the shape of which is as shown in FIG. 30 and a side plate case 118 having a groove 119 are secured and fastened at a certain interval to a stepped hole portion of the a main bearing 412 of a body frame 405 adjacent to a rotary scroll 418. Elements of a rolling piston type pump unit composed of an annular piston 115, a partition vane 117, a coil spring 116 are disposed between the side plate 114 and the side plate case 118.

Figure 29:
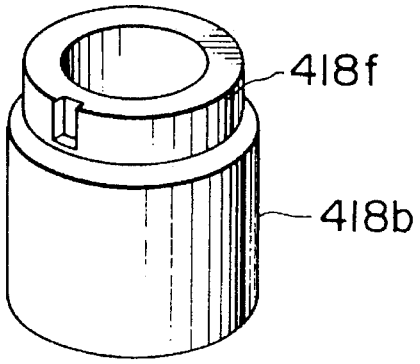
FIG. 29 is a perspective view which illustrates the bearing elements shown in FIG. 28.

A rotary bearing 418*b* having a small-diameter outer portion 418*f*, the shape of which is as shown in FIG. 29, is press-fitted and secured into a rotary boss portion 418*e* of a rotary scroll 418. The inner surface of the rotary bearing 418*b* is engaged with a crank shaft 414 of a drive shaft 404 so as to be slid in the same, and the small-diameter outer portion 418*f* is engaged with the inner surface of the piston 115 so as to be slid in the same.

An oil chamber 478*a* allowed to communicate with the discharge chamber oil reservoir 34 via an oil hole 438*a* formed in the body frame 405 is cut off from a back pressure chamber 439 of the rotary scroll 418 by the side plate case 118 press-fit into the body frame 405 and the annular ring 94 fastened to the end portion of the rotary boss 418*e*.

The side plate 114 is positioned in contact with an end surface 404*a* of the stepped portion of the drive shaft 404 so as to cut off the portion adjacent to the oil hole 438*a* and the portion including the circumferential surface portion of the piston 115.

The oil chamber 478*a* is allowed to communicate with the back pressure chamber 439 via the rolling piston type oil pump unit 120, a spiral oil groove 441*b* formed in the outer surface of the crank shaft 414, an oil chamber 478*b* formed at the end portion of the crank shaft 414, an axial directional oil hole 112*a* formed in the core portion of the drive shaft 404, a spiral oil groove 441*a* and an oil hole 438*b* formed in the body frame 405. The opening of the oil hole 438*b* is intermittently closed by the reciprocating motion of the Oldham's ring 24.

The other structures are the same as those shown in FIG. 25.

Figure 31:
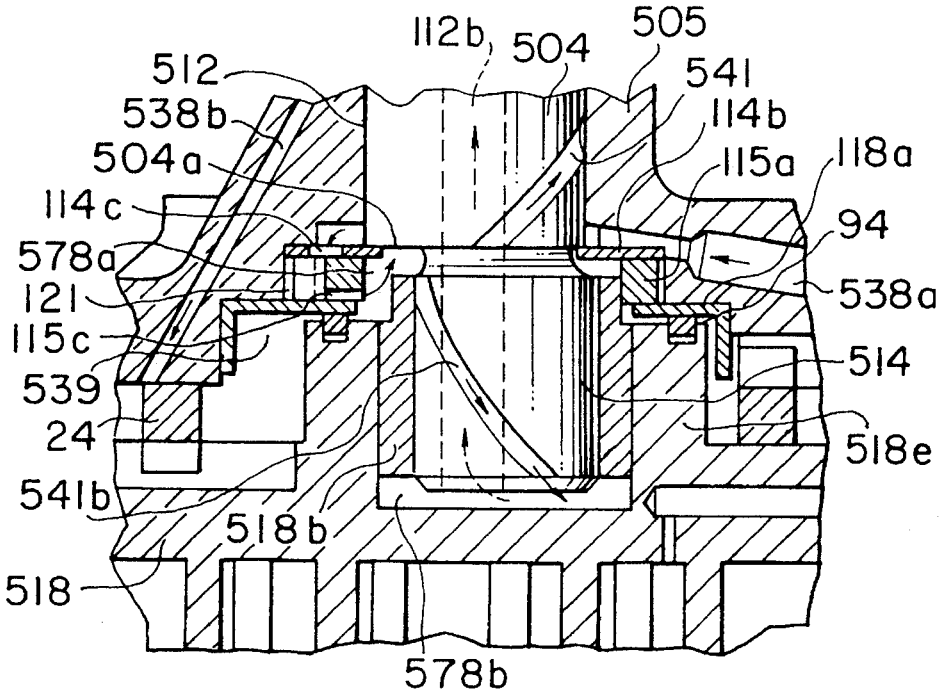
FIG. 31 is a partial cross sectional view which illustrates a main bearing portion of a fifth embodiment of the scroll refrigerant compressor according to the present invention.
Figure 32:
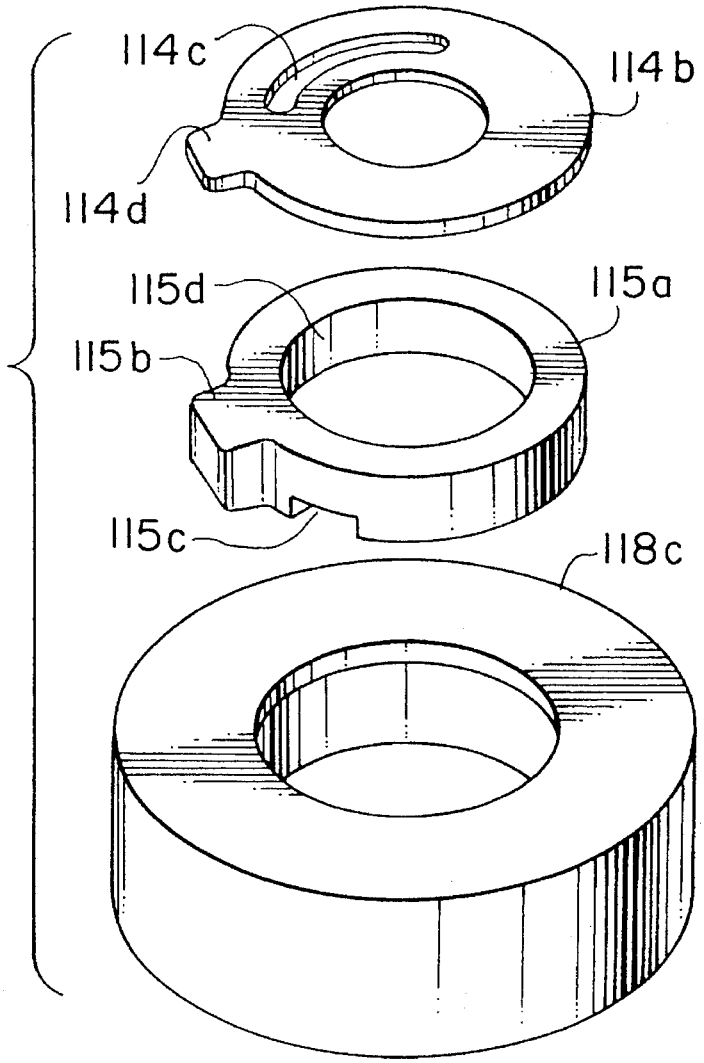
FIG. 32 is a perspective exploded view which illustrates elements of an oil supply pump unit of the compressor.

FIG. 31 is a vertical cross sectional view which illustrates a portion of a portion including the oil supply pump unit disposed at the front portion of the drive shaft of the scroll refrigerant compressor according to a fifth embodiment of the present invention. Similarly to the case shown in FIG. 28, a side plate 114*b* having, as shown in FIG. 32, a circular arc shape suction hole 114*c* and a projecting portion 114*d* and a side plate case 118*a* are fastened and secured at a certain interval in a stepped hole portion of a main bearing 512 of a body frame 505 adjacent to a rotary scroll 518. Elements of a rotary cylinder piston type pump unit comprising an annular shape piston 115*a* having a projecting portion 115*b* and a groove 115*c* and similarly to a rotary cylinder piston type pump unit disclosed in, for example, Japanese Patent Publication No. 61-57935 are disposed between the side plate 114*b* and the side plate case 118*a*.

Figure 33:
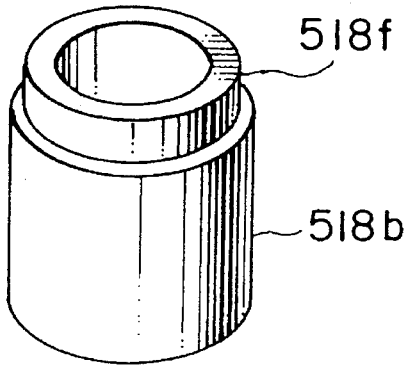
FIG. 33 is a perspective view which illustrates bearing elements shown in FIG. 31.

As shown in FIG. 33, a rotary bearing 518*b* having a small-diameter outer portion 518*f* is press-fit into a rotary boss portion 518*e* of a rotary scroll 518. Therefore, when the rotary scroll 518 performs the rotary motion, the small-diameter outer portion 518*f* intermittently comes in contact with an inner surface 115*d* of the piston 115*a*. As a result, the piston 115*a* performs a rotary and swing motion the diameter of which is smaller than that of the rotary scroll 518 so that a small discharge pump operation is performed.

The projecting portion 115*b* of the piston 115*a* acts to stop the rotation of the piston 115*a* when it is engaged with a cut-out groove 121 formed in the body frame 505.

The side plate 114*b* is positioned in contact with an end surface 504*a* of the stepped portion of a drive shaft 504 so as to cut off the portion adjacent to an oil hole 538*a* and the circumferential surface portion of the piston 115*a*.

An oil chamber 578*a* allowed to communicate with the discharge chamber oil reservoir 34 via an oil hole 538*a* formed in the body frame 505 is cut off from a back pressure chamber 539 of the rotary scroll 518 by the side plate 114*b* press-fit into the body frame 505 and the annular ring 94 fastened to the end portion of the rotary boss 518*e*.

The oil chamber 578*a* is allowed to communicate with the back pressure chamber 539 via a rotary cylinder piston type oil supply pump unit, a spiral oil groove 541*b* formed in the outer surface of a crank shaft 514, an oil chamber 578*b* formed at the end portion of the crank shaft 514, an axial directional oil hole 112*b* formed in the core portion of the drive shaft 504, a spiral oil groove 541*a* and an oil hole 538*b* formed in the body frame 504. The opening of the oil hole 538*b* is intermittently closed by the reciprocating motion of the Oldham's ring 24.

The other structures are the same as those shown in FIG. 25.

Figure 34:
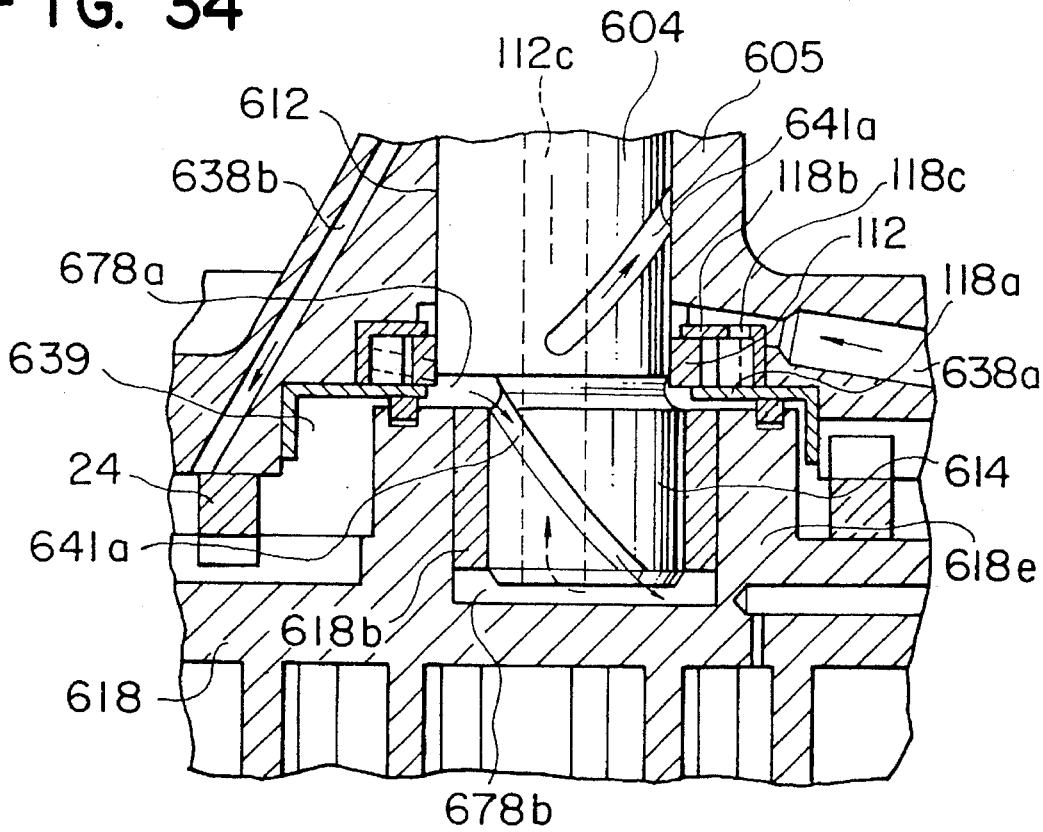
FIG. 34 is a partial cross sectional view which illustrates a main bearing portion of a sixth embodiment of the scroll refrigerant compressor according to the present invention.

FIG. 34 is a vertical cross sectional view which illustrates a portion including the oil supply pump unit disposed at the front portion of the drive shaft of the scroll refrigerant compressor according to a sixth embodiment of the present invention. Similarly, to the cases shown in FIGS. 28 and 31, a side plate case 118*b* and a side plate case 118*a* are, at a certain interval, fastened and secured to a stepped hole portion of a main bearing 612 of a main frame 605 adjacent to a rotary scroll 618. Elements of so-called a slide vane type oil supply pump apparatus comprising two vane grooves 124 and two discharge holes 125 and as well as constituted by a rotor 122 secured to a drive shaft 604 and two vanes 123 fastened to the corresponding vane grooves 124 and reciprocating in the vane grooves 124 are disposed between the side cases 118*a* and 118*b*.

An oil chamber 678*a* allowed to communicate with the discharge chamber oil reservoir 34 via an oil hole 638*a* formed in the body frame 605 is cut off from a back pressure chamber 639 of a rotary scroll 618 by the side plate case 118*a* press-fit into the body frame 605 and the annular ring 94 fastened to the end portion of a rotary boss 618*e*.

The oil chamber 678*a* is allowed to communicate with the back pressure chamber 639 via the slide vane type oil supply apparatus, a spiral oil groove 641*b* formed on the outer surface of a crank shaft 614, an oil chamber 678*b* formed at the end portion of the crank shaft 614, an axial directional oil hole 112*c* formed in the core portion of the drive shaft 604, a spiral oil groove 641*a* and an oil hole 638*b* formed in the body frame 604. The opening of the oil hole 638*b* is intermittently closed by the reciprocating motion of the Oldham's ring 24.

The other structures are the same as those shown in FIG. 25.

Figure 36:
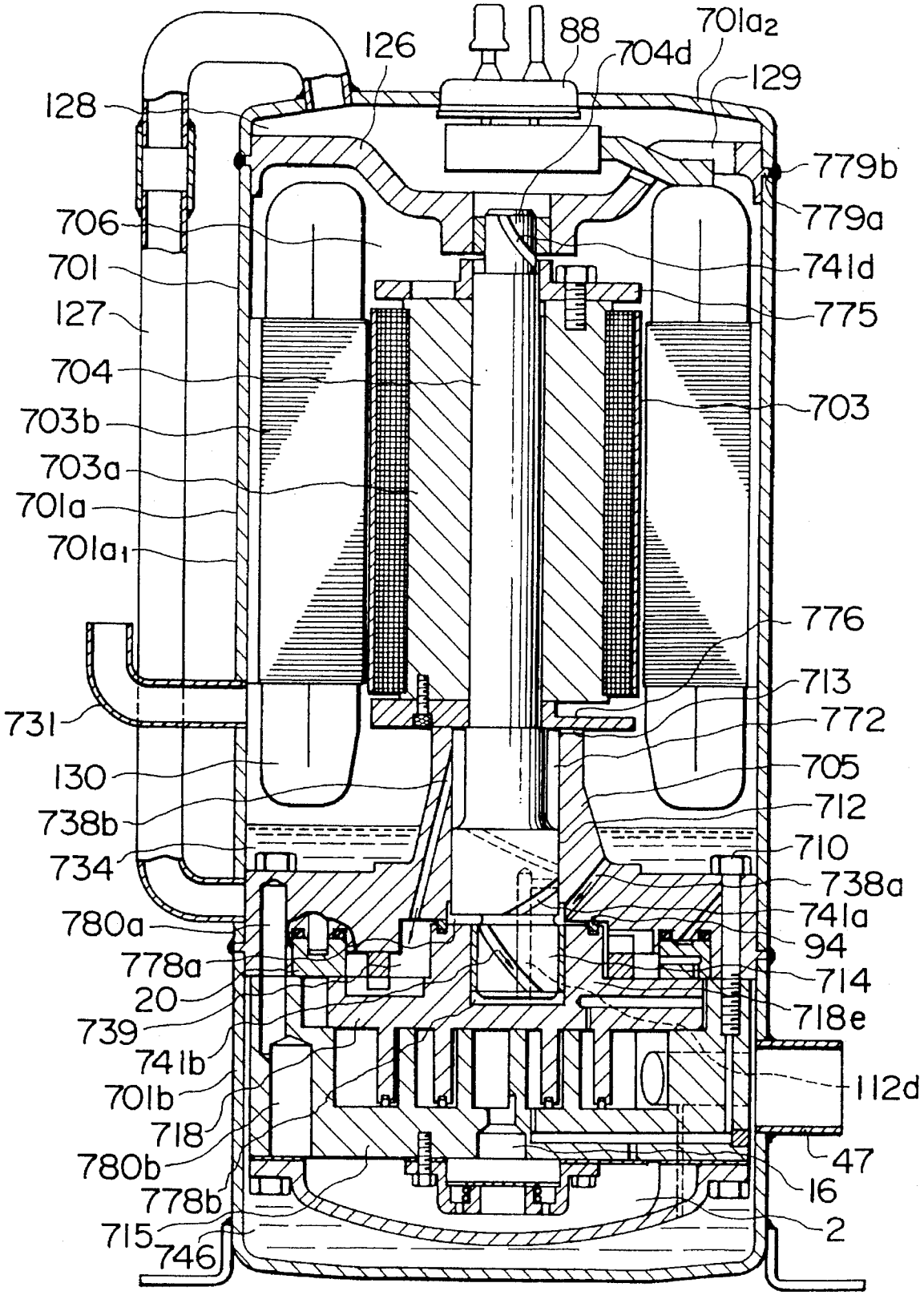
FIG. 36 is a vertical cross sectional view which illustrates a seventh embodiment of the scroll refrigerant compressor according to the present invention.

FIG. 36 is a vertical cross sectional view of a seventh embodiment of the scroll refrigerant compressor. The inside portion of a sealed case 701 made of soft iron is, similarly to the case shown in FIG. 4, partitioned into an upper sealed case 701*a* and a lower sealed case 701*b*. The inside portion of the upper sealed case 701*a* serves as a high pressure space for including a motor 703 similarly to the shown in FIG. 4. The inside portion of the lower sealed case 701*b* serves as a low pressure space allowed to communicate with the lower stream from the evaporator and constitutes an accumulator chamber 746. The upper sealed case 701*a* is constituted by a body shell 701*a*1 for supporting a rotor 703*b* of the motor 703 and an upper shell 701*a*2 in which a glass terminal 88 for establishing a connection with the motor power supply is disposed. Furthermore, an upper frame 126 for supporting an end portion of the drive shaft 704 is disposed between the above-described two shells.

The upper frame 126 is made of gray cast iron displaying bad weldability and possessing vibration damping characteristic. A projecting portion 779*a* formed on its outer surface is positioned in contact with the inner walls of the upper shell 701*a*2 and the body shell 701*a*1 and their end surfaces. A single weld bead 779*b* seals and secures the upper seal 701*a*2 and the body shell 701*a*1, and as well as it secures the projecting portion 779*a* of the upper frame 126 in such a manner that it holds the inside portion. That is, the weld bead 779*b* forms an alloy structure between the upper shell 701*a*2 made of soft iron and the body shell 701*a*1, but no alloy structure is formed with the surface of the upper frame 126 made of the gray cast iron. Therefore, the weld bead 779*b* surrounds and secures the portion around the upper frame 126 while preventing the influence of the welding distortion.

An upper balance weight 775 and a lower balance weight 776 are fastened to the upper and lower end portions of a rotor 703*a* of the motor 703 in such a manner that the axial movement of the rotor 703*a* is restricted in a portion between an end portion of the upper frame 126 and the end portion of the body frame 705.

The diameter of a main bearing 712 of the drive shaft 704 supported by the upper frame 126 and the body frame 705 is arranged to be larger than the sum of the diameter of the crank shaft 714 and the quantity which is two times the crank eccentricity so that the drive shaft 704 can be removed upward.

The lower surface of the lower balance weight 776 is positioned in contact with a thrust bearing portion 713 at the top end portion of the body frame 705 so as to support the drive shaft 704 and the rotor 703*a*.

An oil reservoir 772 in the upper portion of the main bearing 712 is allowed to communicate with a back pressure chamber 739 of a rotary scroll 718 via an oil hole 738*b*.

The thrust bearing 20 is, similarly to the case shown in FIG. 4, allowed to communicate with the compression chamber of the final compression stroke via a gap present between a bolt 710 for fixing a fixed scroll 715 to the body frame 705 and a fastening hole and small gaps around the screw.

The high pressure oil chamber 778*a* is allowed to communicate with the discharge chamber oil reservoir 34 via an oil hole 738*a*.

The discharge chamber 2 formed in the portion of the fixed scroll 715 opposing the compression chamber is allowed to communicate with an oil separation chamber 128 formed in the upper portion of the upper frame 126 via a gas path 780*b* formed in the fixed scroll 715, a gas path 780*a* formed in a body frame 705 and a discharge bypass pipe 127.

The oil separation chamber 128 is allowed to communicate with a discharge pipe 731 formed in a body shell 701*a*1 on the outer surface of a lower motor coil end 130 via a gas hole 129 formed in the upper frame 126 and a motor chamber 706. The surface of an upper end shaft 704*d* of the drive shaft 704 supported by the upper frame 126 has a spiral oil groove 741*d* formed in a direction in which the lubricating oil separated from the discharge gas in the oil separating chamber 128 is introduced into the motor chamber 706 by the viscous pumping operation when the drive shaft 704 forward rotates.

The oil chamber 778*a* allowed to communicate with the discharge chamber oil reservoir 34 via the oil hole 738*a* formed in the body frame 705 is cut off from a back pressure chamber 739 of a rotary scroll 718 by the annular ring 94 fastened to the end portion of a rotary boss portion 718*e* of a rotary scroll 718.

The oil chamber 778*a* is allowed to communicate with the back pressure chamber 739 via a spiral oil groove 741*b* formed in the outer surface of the crank shaft 714, an oil chamber 778*b* formed in the end portion of the crank shaft 714, an axial directional oil hole 112*c* formed in the drive shaft 704, a spiral oil groove 741*a*, an oil reservoir 772 and the oil hole 738*b*. An end portion of the opening side of the oil hole 738*b* is intermittently closed by the rotary motion of the annular ring 94.

The other structures are the same as those shown in FIG. 4.

Figure 37:
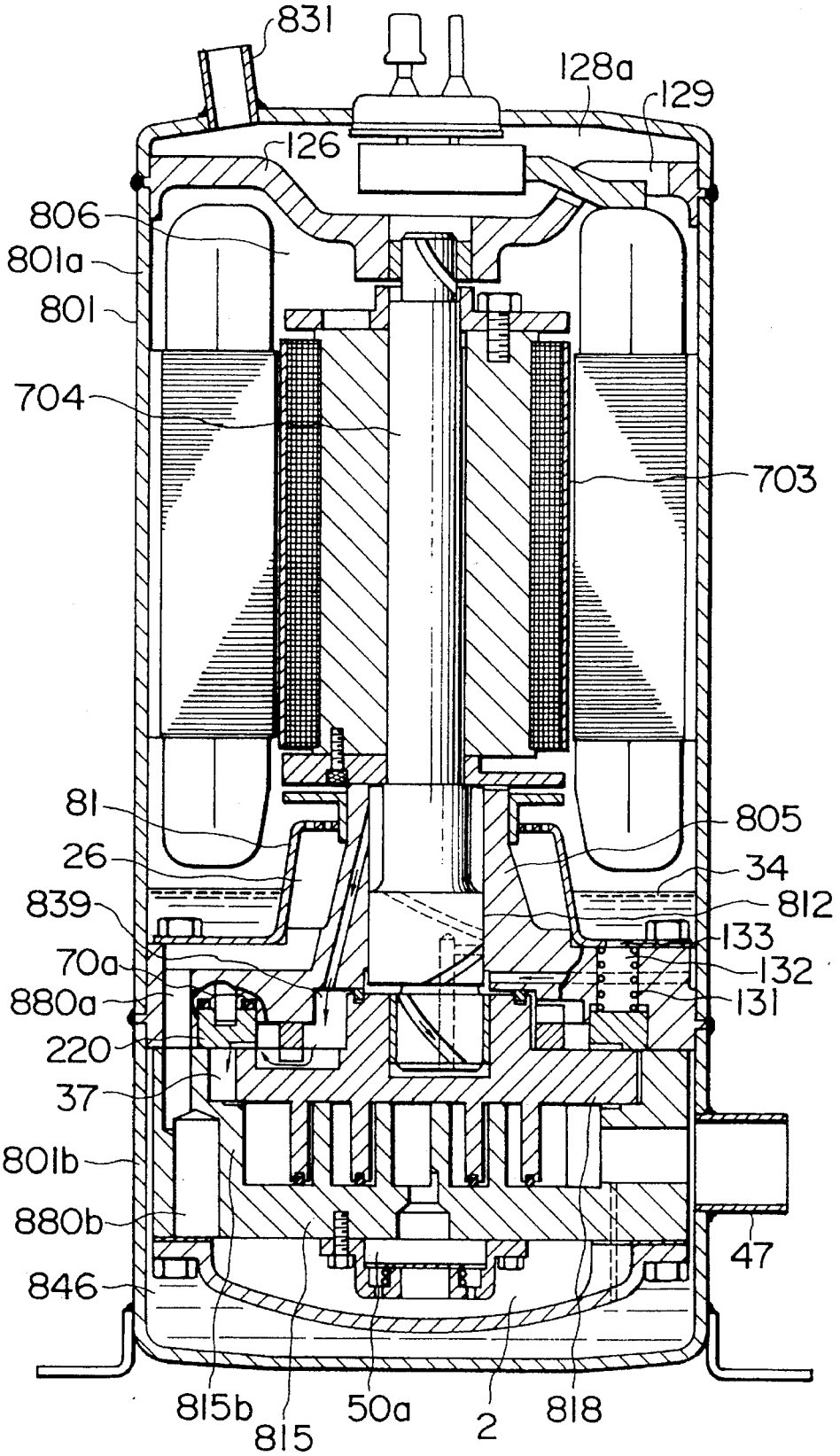
FIG. 37 is a vertical cross sectional view which illustrates an eighth embodiment of the scroll refrigerant compressor according to the present invention.

FIG. 37 is a vertical cross sectional view of an eighth embodiment of the scroll refrigerant compressor. The inside portion of a sealed case 801 made of soft iron is, similarly to the cases shown in FIGS. 4 and 36, partitioned into an upper sealed case 801*a* and a lower sealed case 801*b* by a body frame 805 supporting the drive shaft 704. The inside portion of the upper sealed case 801*a* serves as a high pressure space for including the motor 703. The inside portion of the lower sealed case 801*b* serves as a low pressure space allowed to communicate with the lower stream from the evaporator and constitutes an accumulator chamber 846.

The drive shaft 704 for connecting the motor 703 is, similarly to the case shown in FIG. 36, supported by a main bearing 812 of the body frame 805 and the upper frame 126.

The discharge chamber 2 is allowed to communicate with a high pressure motor chamber 806 via a gas path 880*b* formed in a fixed scroll 815, a gas path 880*a* formed in the body frame 805 and the discharge chamber 2*c* formed by the body frame 805 and the discharge guide 81.

A discharge pipe 831 disposed at the top end portion of the upper sealed case 801*a* is allowed to communicate with the motor chamber 806 via the gas hole 129 formed in the upper frame 126.

A plurality of coil springs 131 are disposed in the portion adjacent to a thrust bearing 220 opposing the compression chamber, the end surface of each of the coil springs being pushed by a discharge guide 881 fastened to the body frame 805 to push the thrust bearing 220 to an end plate 815*b* of the fixed scroll 815.

The portion adjacent to the back side of the thrust bearing 220 is allowed to communicate with the discharge chamber oil reservoir 34 by the coil spring fastening hole 132 formed in the body frame 805 and the oil introduction hole 133 formed in the discharge guide 881.

A seal ring 70*a* is fastened to only the inside of the portion adjacent to the thrust bearing 220, while the outer portion of the same is sealed by a fact that the thrust bearing 220 abuts against the end plate 815*b*.

The other structures are the same as those shown in FIG. 36.

Figure 38:
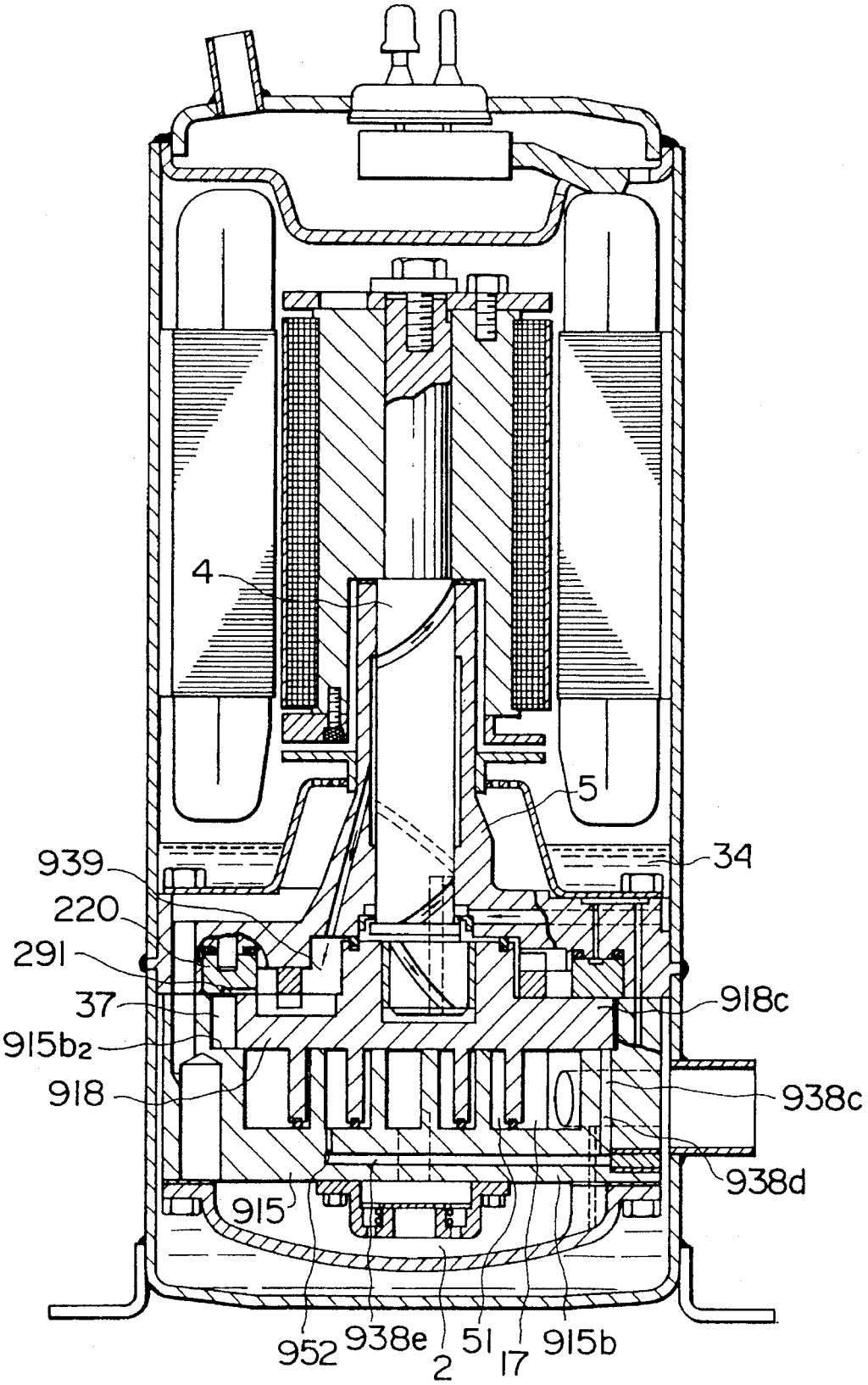
FIG. 38 is a vertical cross sectional view which illustrates a ninth embodiment of the scroll refrigerant compressor according to the present invention.

FIG. 38 is a vertical cross sectional view of a ninth embodiment of the scroll refrigerant compressor according to the present invention. The second compression chambers 51*a* and 51*b* which are intermittently allowed to communicate with the suction chamber 17 and the outer space 37 of a rotary scroll 918 are allowed to communicate with each other by an oil hole 938*c* formed in an end plate sliding surface 915*b*2 of a fixed scroll 915 and an injection hole 952 having a small diameter.

The oil hole 938*c* is formed by a throttle path 938*d* opened in the outer space 37 and an oil reservoir path 938*e* allowed to communicate with the injection hole 952.

The position of the throttle path 938*e* is arranged in such a manner that it is allowed to communicate with the outer space 37 only when the second compression chambers 51*a* and 51*b*, which are intermittently allowed to communicate with the suction chamber 17, are performing the suction stroke (the state of the first compression chambers 61*a* and 61*b*) and it is cut off from the outer space 37 by a wrap support disc 918*c* of a rotary scroll 918 when the second compression chambers 51*a* and 51*b* are performing the compression stroke.

A back pressure chamber 939 of the rotary scroll 918 and the outer space 37 are arranged in such a manner that they are allowed to communicate with each other via an oil groove 291 formed in the thrust bearing 220 only when the second compression chambers 51*a* and 51*b*, which are intermittently allowed to communicate with the suction chamber 17, are performing the suction stroke (the state of the first compression chambers 61*a* and 61*b*) and they are cut off by the wrap support disc 918*c* of the rotary scroll 918 when the second compression chambers 51*a* and 51*b* are performing the compression stroke.

The oil groove 291 formed in the thrust bearing 220 and an opening of the oil hole 938 formed in the fixed scroll 915 toward the end plate sliding surface 915*b*2 are formed to confront each other with respect to the central portion of the rotary scroll 918.

The other structures are the same as those according to the first and second embodiments shown in FIGS. 4 to 19 and 20 to 24.

Figure 39:
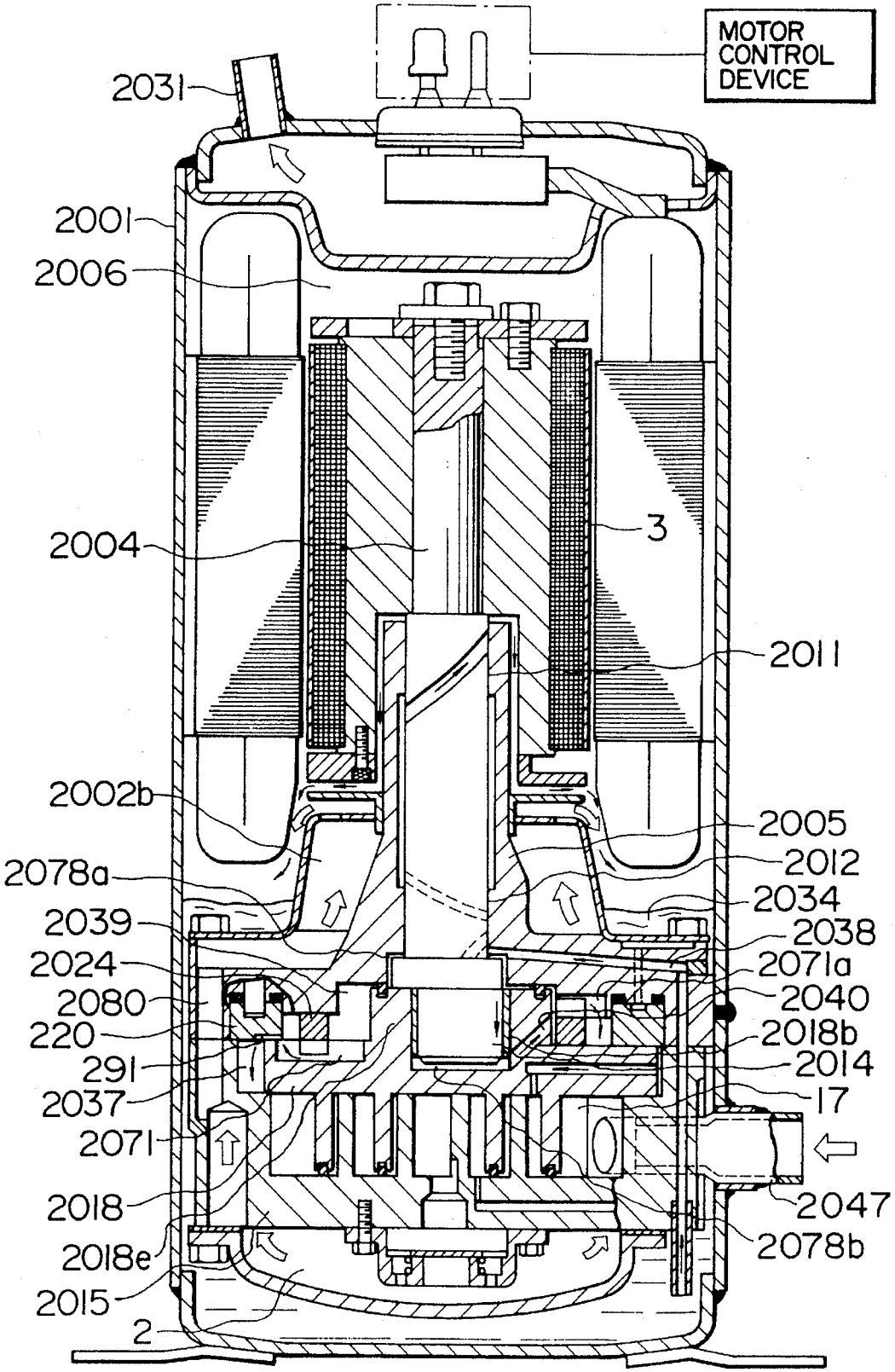
FIG. 39 is a vertical cross sectional view which illustrates a tenth embodiment of the scroll refrigerant compressor according to the present invention.

FIG. 39 is a vertical cross sectional view of a tenth embodiment of the scroll refrigerant compressor according to the present invention. The inside portion of a sealed case 2001 is a high pressure space having, in the lower portion thereof, a discharge chamber oil reservoir 2034 and a scroll compression mechanism portion and, in the upper portion thereof, the motor 3.

The suction chamber 17 is allowed to directly communicate with the low pressure side on the outer side of the compressor via a suction pipe 2047 which penetrates the side wall of a sealed case made of iron.

A body frame 2005 made of cast iron secures a fixed scroll 2015 and is welded to the side wall of the sealed case at several points.

A drive shaft 2004 connected to the motor 3 is supported by a main bearing 2012 disposed adjacent to the compression portion of the body frame 2005 and an upper bearing 2011 adjacent to the motor, and its crank shaft 2014 is slidably connected to the portion including a rotary bearing 2018*b* of a rotary scroll 2018.

The discharge chamber oil reservoir 2034 is allowed to communicate with an oil chamber 2078*a* of the main bearing 2012 adjacent to the compression chamber via an oil suction path 2038 formed in the body frame 2005 and the fixed scroll 2015.

An oil chamber 2078*b* formed by the crank shaft 2014 and the rotary bearing 2018*b* is allowed to communicate with a back pressure chamber 2039 via a small hole 2040 formed in a rotary boss portion 2018*e* of the rotary scroll 2018 and as well as allowed to communicate with the oil chamber 2078*a* via a gap of the sliding portion of the rotary bearing 2018*b*.

It is arranged in such a manner that an outer space 2037 of the rotary scroll 2018 and the back pressure chamber 2039 are intermittently allowed to communicate with each other via a key seat 2071 of the rotary scroll 2018, which is arranged to be engaged with an Oldham's ring 2024 and the oil groove 291 formed in the thrust bearing 220 only when the second compression chambers 51*a* and 51*b* (see FIG. 17) are allowed to communicate with the suction chamber 17. The second compression chambers 51*a* and 51*b* (see FIG. 17) are allowed to communicate with the suction chamber 17.

Each of the oil grooves 291 and the key seats 2071 formed in two places are positioned to confront each other so as to be intermittently allowed to communicate with each other by making a phase angle between the back pressure chamber 2039 and the outer space 2037 when the rotary scroll 2018 performs the rotary motion.

Since the other structures are the same as those according to the first and second embodiments, their descriptions are omitted here.

Then, the operation of the scroll compressor thus-constituted will now be described.

Referring to FIGS. 4 to 19, when the drive shaft 4 is rotated by the motor 3, the rotation of the rotary scroll 18 around the main axis of the drive shaft 4 by means of the crank mechanism of the drive shaft 4 is prevented because the key portion (see FIG. 5) of the Oldham's ring 24 adjacent to the rotary scroll 18 is engaged with the key seal 71 of the rotary scroll and the key portion disposed in the opposing portion is engaged with the key groove 71*a* of the body frame 5. Therefore, it performs a rolling motion so that it changes the capacity of the compression chamber in association with the fixed scroll 15. As a result, the suction and the compression operations of the refrigerant gas are performed.

The refrigerant in the form of a mixture of gas and liquid containing the lubricating oil sucked from a refrigerating cycle connected to the compressor is introduced into the accumulator chamber 46 through the suction pipe 47 before it conflicts the outer surface of the end plate 15*b* of the fixed scroll 15. Then, it passes through a space above the accumulator chamber 46 before it is introduced into the suction chamber through the two suction holes 43.

On the other hand, the liquid refrigerant and the lubricating oil separated from the refrigerant gas due to the difference in the weight between the gas and liquid and the inertia force at the time of changing in the direction of the flow are temporarily gathered in the bottom portion of the accumulator chamber 46. Then, they are, in the form of mist, upward sucked into the suction hole 43 via the oil suction hole 9*a* and the oil suction hole 9*b* due to the negative pressure generated when the sucked refrigerant gas passes through the suction hole 43 before they are again mixed to the sucked refrigerant gas.

The sucked refrigerant gas is, after the gas and the liquid have been separated from each other, enclosed in the compression chamber after it has passed through the suction chamber 17 and the first compression chambers 61*a* and 61*b* formed between the rotary scroll 18 and the fixed scroll 15. Then, it is sequentially conveyed, while being compressed, to the second compression chambers 51*a* and 51*b* and the third compression chambers 60*a* and 60*b* before it is discharged to the check valve chamber 50*a* through the discharge port 16 formed at the central portion. Then, it is discharged to the motor chamber 6 after it has sequentially passed through the discharge chamber 2, the gas path 80*b*, the gas path 80*a* and the discharge chamber 2*b*.

Since the compression chamber and the discharge port 16 are allowed to communicate with each other after the compression has been completed, the compressed refrigerant gas is rapidly primary-expanded when it is introduced from the compression chamber into the check valve chamber 50*a*. During the discharge completion stroke immediately after this to the compression completion stroke, the discharged refrigerant gas from the check valve chamber 50*a* primarily reversely flows into the compression chamber.

As a result, the refrigerant gas is, on the whole, discharged from the compression chamber into the discharge chamber 2 while repeating the intermittent discharge and introduction to and from the compression chamber. The refrigerant gas discharged from the check valve chamber 50*a* and the discharge chamber 2 encounters a pulsation phenomenon because the pressure is changed when it is introduced/discharged to and from the compression chamber.

The pulsation of the discharged refrigerant gas is sequentially reduced due to the secondary expansion taken place when the refrigerant gas is introduced into the discharge chamber 2 via the discharge apertures 50*h* of the check valve device 50 and the third and fourth expansions taken place when the same is introduced from the two discharge paths 80 into the discharge chamber 2*b* and the motor chamber 6. As a result, the pressure change in the motor chamber 6 can be substantially damped.

When the discharge refrigerant gas instantaneously reversely flows from the discharge chamber 2 to the check valve chamber 50*a*, the valve body 50*b* tends, while following the above-described flow, to move in a direction in which it closes the discharge port 16. However, since the coil spring 50*c* having the shape memory characteristic depending upon the atmospheric temperature is completely contracted and thereby it does not give the urging force the valve body 50*b* during the operation of the compressor and as well as the magnetized valve body 50 adheres to the bottom surface of the check valve chamber 50 and thereby it does not separate from the same, the valve body 50*b* does not cover the discharge port 16.

The discharged refrigerant gas scattered and discharged from the apertures 81*a* of the discharge guide 81 into the motor chamber 6 comes in contact with the annular shielding plate 86 and the wound wire of the motor 3 before it passes through the paths on the inside and outside the stator 3*b* toward the upper side portion of the motor chamber 6 while cooling the motor 3. Then, it passes into the external refrigerating cycle through the discharge pipe 31.

At this time, the lubricating oil contained in the discharged refrigerant gas is partially separated from the refrigerant gas because it adheres to the surface of the wound wire positioned in the lower portion of the motor 3, the separated lubricating oil being gathered into the discharge chamber oil reservoir 34. However, the lubricating oil in the discharged refrigerant gas, which passes through the outer portion of the upper balance weight 75 and the lower balance weight 75, is centrifugal-separated by the rotation of the upper balance weight 75 and the lower balance weight 76 before it is dispersed on the inner surface of the wound wire of the motor 3. It then moves downward along the internal space of the wound wire bundle before it is gathered in the discharge chamber oil reservoir 34.

The release gap 27 on the back side of the thrust bearing 20 which is allowed to communicate with the compression chamber (the compression space at the stroke immediately before the portion at which the compression chamber communicates with the discharge port 16) in the final compression stroke is filled with the high pressure refrigerant gas immediately after the compression has been commenced. The thrust bearing 20 is pushed against the end plate fastening surface 15*b*1 of the fixed scroll 15 by the urging force of its back pressure and the elastic force of the seal ring 70. As a result, the wrap support disc 18*c* of the rotary scroll 18 is held between the end plate sliding surface 15*b*2 and the thrust bearing 20.

The lubricating oil in the discharge chamber oil reservoir 34 is introduced into the back pressure chamber 39 after the passage to be described later so as to gradually raise the pressure of the back pressure chamber, the back pressure pushing the wrap support disc 18*c* of the rotary scroll 18 against the end plate sliding surface 15*b*2. As a result, the gap present between the front portion of the fixed scroll wrap 15*a* and the wrap support disc 18*c* of the rotary scroll 18 is eliminated. Therefore, the compression chamber is sealed so that the sucked refrigerant gas is efficiently compressed and thereby the safety operation is continued.

The axial directional gap between the front portion of the rotary scroll wrap 18*a* and the fixed scroll 15 is sealed because the refrigerant gas is introduced into the tip seal groove 98 when the refrigerant gas leaks into the adjacent low pressure compression chamber during the compression and the gas back pressure generated in the tip seal groove 98 pushes the tip seal 98*a* against the side surface of the bottom compression chamber of the tip seal groove 98*a* and the fixed scroll 15.

Figure 11:
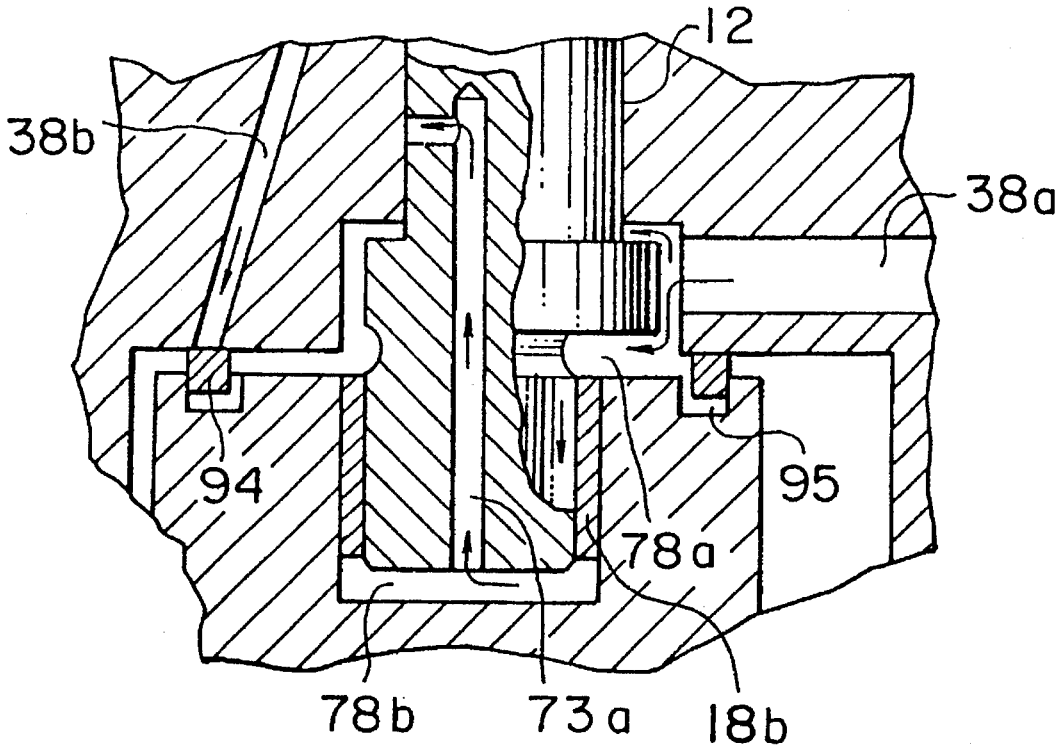
FIG. 11 is a partial cross sectional view which illustrates a main bearing portion of the compressor.

After the operation of the compressor has been stopped, the rotary scroll 18 instantaneously performs the reverse rotation due to the reverse flow due to the pressure difference of the refrigerant gas in the compression chamber. However, the rotary scroll 18 is stopped at the rotary angle in a state as shown in FIG. 17 in which the first compression chambers 61*a* and 61*b* are allowed to communicate with the suction chamber 17 because the refrigerant gas reversely flows from the compression chamber to the suction chamber 17. As shown in FIG. 11, the annular ring 94 closes the lubricating oil introduction port into the back pressure chamber 39.

After the operation of the compressor has been stopped, the refrigerant gas in the compression chamber reversely flows into the suction chamber 17, causing the pressure of the refrigerant gas at the discharge port 16 to be rapidly lowered. As a result, the generated pressure difference between the discharge port 16 and the discharge chamber 2 causes the valve body 50*b* to close the discharge port 16. Therefore, the continuous reverse flow of the discharged refrigerant gas from the discharge chamber 2 into the compression chamber is prevented.

The magnetized valve body 50*b* is separated from the bottom surface of the check valve chamber 50*a* due to the pressure difference after the operation of the compressor has been stopped to the pressure balance in refrigerating cycle is established. As a result, the valve body 51*b* continues to close the discharge port 16. Simultaneously, the coil spring 50 possessing the shape memory characteristic is elongated due to lowering of the temperature. As a result, the valve body 50*b* continues to close the discharge port 16 due to the urging force of the coil spring 50.

The first compression chambers 61*a* and 61*b*, which are intermittently allowed to communicate with the suction chamber 17, and the back pressure chamber 39 are allowed to communicate with each other via the oil hole 91 formed in the thrust bearing 20 only when the first compression chambers 61*a* and 61*b* are allowed to communicate with the suction chamber 17. Furthermore, the reverse flow of the refrigerant gas into the back pressure chamber 39 from the compression chamber during the compression is prevented because the portion between the thrust bearing 20 and the wrap support disc 18*c* are sealed by the lubricating oil film.

During the stoppage of the operation of the compressor, the pressure is balanced in the compressor and thereby the liquid refrigerant is introduced into the compression chamber as well as the accumulator chamber 46. Therefore, the liquid compression can easily take place at the initial stage of the cool start of the compressor. Therefore, thrust force in a direction opposing the discharge port 16 acts on the rotary scroll 18 due to the pressure of the compressed refrigerant in the compressor.

On the other hand, the pressure in the back pressure chamber 39 is low at the initial stage of the cool start of the compressor. Therefore, the wrap support disc 18*c* of the rotary scroll 18 is separated from the end plate sliding surface 15*b*2 until it reaches the thrust bearing 20 at which it is supported at this retraction position. As a result, a gap is generated between the wrap support disc 18*c* and the front portion of the fixed scroll wrap 15*a*, causing the pressure in the compression chamber to be reduced. Therefore, the compression load at the initial stage of the start is reduced.

If the pressure in the compression chamber is instantaneously excessively raised due to, for example, the liquid compression taken place in the compression chamber, the thrust force acting on the rotary scroll 18 is enlarged than the urging force caused by the back pressure acting on the back side of the rotary scroll 18. As a result, the rotary scroll 18 is moved in the axial direction so as to be supported by the thrust bearing 20. Then, the sealing of the compression chamber is, similarly to the above-described case, cancelled and thereby the pressure in the compression chamber is lowered, causing the compression load to be reduced.

The lubricating oil in the discharge chamber oil reservoir 34 at the initial stage of the cool start of the compressor is sucked into the oil chamber 78*a* via the oil hole 38*a* by the screw-pump operation of the spiral oil grooves 41*a* and 41*b* formed in the drive shaft 4.

Then, a portion of the lubricating oil lubricates the sliding surface of the rotary bearing 18*b*after it has passed through the spiral oil groove 41*b*, the oil chamber 78*b* and the oil supply hole 73*a* before it is supplied to the sliding surface of the main bearing 12, the portion of the lubricating oil being then supplied to the oil reservoir 72.

The lubricating oil supplied to the main bearing 12 by means of the spiral oil groove 41*a* joins the lubricating oil, which has passed through the oil chamber 78*b*, at the oil reservoir 72. Then, the pressure of a portion of the lubricating oil is reduced at the throttle path portion of the oil hole 38*b* before it is intermittently supplied to the back pressure chamber 39. The residual portion of the lubricating oil lubricates the sliding surface of each of the upper bearing 11 and the thrust bearing 13 before it is recovered again in the discharge chamber oil reservoir 34.

The oil reservoir 72 and the motor chamber 6 are cut off from each other by the sealing action performed by the oil film which lubricates the upper bearing 11.

The pressure in the motor chamber 6 is raised after the lapse of time from the initial stage of the cool start of the compressor and thereby the lubricating oil in the discharge chamber oil reservoir 34 is sucked into the oil chamber 78*a* due to also the pressure difference from the back pressure chamber 39. Then, it is supplied to the back pressure chamber 39 as well as by virtue of the screw-pump action performed by the spiral oil grooves 41*a* and 41*b*, causing the pressure in the back pressure chamber 39 to be successively raised.

Since the annular ring 94 rotates together with the rotary scroll 18 in the configuration in which the center of the compression chamber, the center of the rotary bearing 18*e* and the center of the annular ring 94 are made to coincide with each other. Therefore, the annular ring 94 tends to jump the annular seal groove 95 formed in the rotary boss portion 18*e* due to the inertia force at the time of the rotary motion. As a result, the annular ring 94 is pushed against the body frame 5 and the outer surface of the annular seal groove 95. Furthermore, the lubricating oil is pushed into the portion between the annular seal groove 95 and the annular ring 94 due to the oil scraping action performed by the annular ring 94. As a result, the annular ring 94 is pushed also due to the generation of the dynamic pressure at this time so that the portion between the oil chamber 78*a* and the back pressure chamber 39 are sealed.

Furthermore, the annular ring 94 is pushed to the outer surface of the annular seal groove 95 also due to the pressure difference between the back pressure chamber 39 and the oil chamber 78*a*. Therefore, the above-described two spaces can be further assuredly sealed.

The sliding surface between the annular ring 94 and the body frame 5 is sealed by the oil film of the lubricating oil retained in the oil groove 94*a* formed in the surface of the annular groove 94 and as well as the wear and the resistance due to the sliding taken at the sliding surface are reduced.

The rotary scroll 18 is equally urged with the back pressure toward the fixed scroll 15 by the pressure of the lubricating oil in the high pressure oil chamber 78*a* and the pressure of the lubricating oil in the intermediate pressure back pressure chamber 39. As a result, the wrap support disc 18*c* and the end plate sliding surface 15*b*2 smoothly slide each other and as well as the deformation of the wrap support disc 18*c* is reduced, causing the axial directional gap of the compression chamber to be minimized.

The lubricating oil introduced into the back pressure chamber 39 is intermittently introduced into the outer space 37 via the oil hole 91 formed in the thrust bearing 20. Furthermore, the pressure of it is gradually reduced when it passes through the oil hole 38*c* formed in the wrap support disc 18*c* and the injection hole 52 having a small diameter before it is introduced into the second compression chambers 51*a* and 51*b* while lubricating each sliding surface through the path to seal the gap in the sliding portions.

The lubricating oil introduced into the second compression chambers 51*a* and 51*b* joins the lubricating oil introduced into the compression chamber together with the sucked refrigerant gas to seal the small gap in the adjacent compression chambers with the oil film. As a result, it prevents the leakage of the compressed refrigerant gas and is again discharged into the motor chamber 6 together with the compressed refrigerant gas while lubricating the sliding surface between compression chambers.

In the oil supply path constituted from the discharge chamber oil reservoir 34 to the second compression chambers 51*a* and 51*b* via the back pressure chamber 39, a proper intermediate pressure level between the discharge pressure and the sucked pressure is maintained in the back pressure chamber 39. The pressure of each of the opening portions of the injection holes 52*a* and 52*b* of the second compression chambers 51*a* and 51*b* changes as shown in FIG. 19. Therefore, it is instantaneously higher than the back pressure chamber pressure 68 which is changed following the pressure of the motor chamber 6. However, the back pressure chamber 39 and the outer space 37 are arranged in such a manner that the wrap support disc 18*c* closes the opening end portion of the oil hole 91 of the thrust bearing 20 and the sliding surface between the wrap support disc 18*c* and the thrust bearing 20 is sealed with the oil film. Therefore, the refrigerant gas which is being compressed does not reversely flow into the back pressure chamber 39. Furthermore, the average pressure of the second compression chambers 51*a* and 51*b* is lower than that in the back pressure chamber 39.

As described above, the rotary scroll 18 at the initial stage at the compressor start is separated from the fixed scroll 15 and is supported by the thrust bearing 20 which receives the elastic force of the seal ring 70 and the back pressure of the refrigerant gas introduced from the compression chamber in the compression stroke.

The lubricating oil supplied to the back pressure chamber 39 due to the pressure difference after the start of the compressor has been stabilized gives the rotary scroll 18 the urging force of the intermediate pressure. As a result, the wrap support disc 18*c* is pressed against the end plate 15*b* to seal the sliding surface with the oil film so that the portion between the outer space 37 and the suction chamber 17 is sealed.

The lubricating oil in the back pressure chamber 39 is present in the gap in the sliding surface between the thrust bearing 20 and the wrap support disc 18*c* so that the gap is sealed.

Since the compression ratio of the scroll compressor is constant, the rotary scroll 18 separates from the fixed scroll 15 and is supported by the thrust bearing 20 if the pressure of the sucked refrigerant gas is relatively high as is shown in the case immediately after the cool start and thereby the pressure in the compression chamber is excessively raised or if an excessive liquid compression takes place.

However, since the thrust bearing 20 urged with the back pressure cannot bear the load due to the pressure of the compression chamber, which has been excessively raised, it is retracted in a direction in which the release gap 27 is reduced. As a result, the axial directional gap between the wrap support disc 18*c* of the rotary scroll 18 and the front portion of the fixed scroll wrap 15*a* of the fixed scroll 15 is enlarged. As a result, a large quantity of leakage takes place in the portion between the compression chambers. Therefore, the pressure in the compression chamber is rapidly lowered during the compression as designated by an alternate long and short dash line 63*a* of FIG. 18.

After the compression load has been instantaneously reduced, the thrust bearing 20 instantaneously restores its original position. Therefore, the pressure of the back pressure chamber 39 is not excessively lowered, causing the stable operation is again continued.

When the rotary scroll 18 retracts toward the thrust bearing 20, the axial directional distance from the front portion of the rotary scroll wrap 18*a* to the fixed scroll 15 is lengthened. However, since the tip seal 98*a* is pressed toward the fixed scroll 15 by the gas pressure on its back side, the leakage of the compressed refrigerant gas from the above-described portion can substantially be prevented.

If a foreign matter is caught in the axial directional gap between the rotary scroll 18 and the fixed scroll 15, the thrust bearing 20 is retracted similarly to the above-described case, causing the foreign matter to be removed.

The pressure in the compression chamber in a case where the liquid compression is generated instantaneously at the time of the initial stage of the cool start or the normal operation takes place the excessive compression as designated by a dashed line 63 of FIG. 18. However, the capacity of the high pressure space which is allowed to communicate with the discharge port 16 is large and expansions are repeated during the sequential passage through the check valve chamber 50*a*, the discharge chamber 2 and the discharge chamber 2*b*. Therefore, the pressure in the motor chamber 6 is not substantially changed.

Furthermore, the leakage of the refrigerant gas from the compression chamber per unit time is reduced in proportion to the increase in the operational speed of the compressor. On the contrary, the time in which the injection holes 52*a* and 52*b* per rotation is shortened, causing the quantity of oil injection into the compression chamber to be restricted. Furthermore, the passage resistance is increased due to the increase in the cutting off speed between the oil hole 38*b* and the back pressure chamber 39. Therefore, the quantity of the lubricating oil to be introduced from the oil chamber 78*a* into the back pressure chamber 39 is restricted. As a result, the pressure in the back pressure chamber 39 is properly retained.

The scroll refrigerant compressor which is included in the heat pump refrigerating cycle and which is being operated is arranged in such a manner that the high pressure side is allowed to communicate with the evaporator and the low pressure side is allowed to communicate with the condenser although its time is short when the heating operation is switched to a moisture eliminating operation. Therefore, the pressure in the motor chamber 6 is instantaneously lowered. Following it, the pressure in the back pressure chamber 39 allowed to communicate with the motor chamber 6 is lowered and thereby the proper back pressure will be sometimes impossible to be retained. In this case, the plunger 29 of the back pressure control valve device 25 provided for the wrap support disc 18*c* is moved toward the outer space 37 as shown in FIG. 16 against the back pressure force of the lubricating oil allowed to communicate with the coil spring 53 and the back pressure chamber 39 by the pressure of the lubricating oil in the oil hole 54*b* allowed to communicate with the oil chamber 78*b*. As a result, the oil chamber 78*b* and the back pressure chamber 39 are allowed to communicate with each other so that the high pressure lubricating oil is introduced into the back pressure chamber 39. As a result, the pressure of the back pressure chamber 39 is restored to the proper pressure. Therefore, the plunger 29 is again moved toward the oil chamber 78*b* as shown in FIG. 15, causing the oil chamber 78*b* and the back pressure chamber 39 to be cut off from each other.

In a case where the thermal load on the evaporator side is large and the condensing performance on the condenser side is large, the operation is performed in such a manner that the suction pressure is relatively high and the discharge pressure is relatively low.

In this case, it is necessary for the pressure in the back pressure to be raised in comparison to that at the normal state because the pressure in the compression chamber is higher than that at the normal operation. Also in this case similarly to the above-described case, the plunger 29 is moved toward the outer space 37 as shown in FIG. 16 by the pressure of the lubricating oil in the oil hole 54*b* allowed to communicate with the oil chamber 78*b* and the pressure of the refrigerant on the suction side which is allowed to communicate with the suction chamber 17 via the oil hole 54*a* against the back pressure force of the lubricating oil allowed to communicate with the coil spring 53 and the back pressure chamber 39. As a result, the oil chamber 78*b* and the back pressure chamber 39 are intermittently (or partially) allowed to communicate with each other, causing the high pressure lubricating oil to be introduced into the back pressure chamber 39. As a result, the pressure of the back pressure chamber 39 is retained at the proper level.

The plunger 29 is, of course, influenced by the centrifugal force, the inertia force and frictional force acting on the plunger 29. Therefore, since it tends to be moved toward the outer space 37, the pressure in the back pressure chamber 39 is raised following the increase in the operational speed of the compressor.

Although the compressed refrigerant gas during the final compression stroke is introduced into the release gap 27 formed on the back side of the thrust bearing 20 according to the above-described embodiment, the discharged refrigerant gas in a region in which the compression chamber in the compression final stroke and the discharge port are allowed to communicate with each other may be introduced into the release gap 27.

Figure 6:
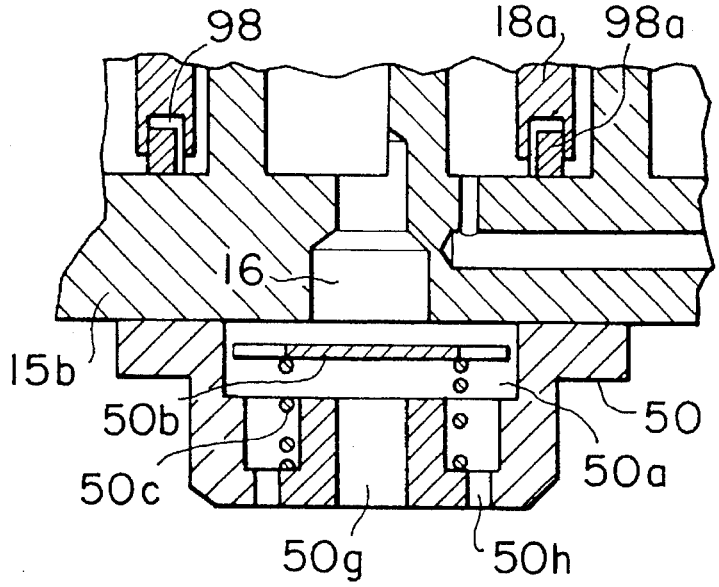
FIG. 6 is a partial cross sectional view which illustrates a check valve unit disposed in a discharge port portion of the compressor.
Figure 7:
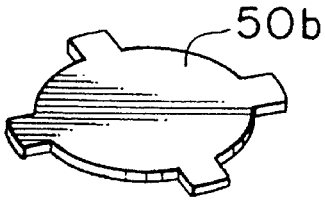
FIGS. 7, 8 and 9 are respectively perspective views which illustrate elements of the check valve unit shown in FIG. 6.
Figure 8:
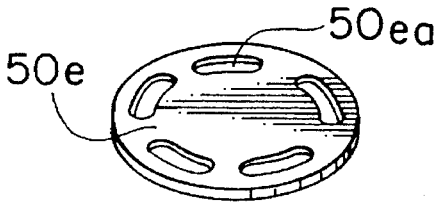
Figure 9:
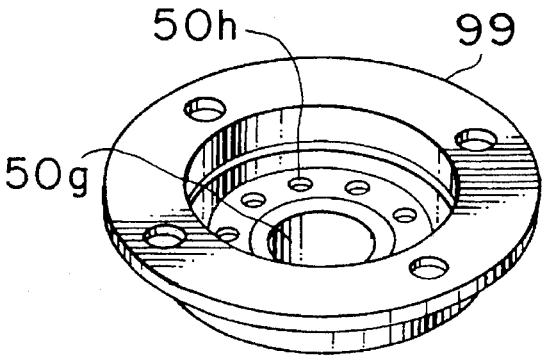
Figure 10:
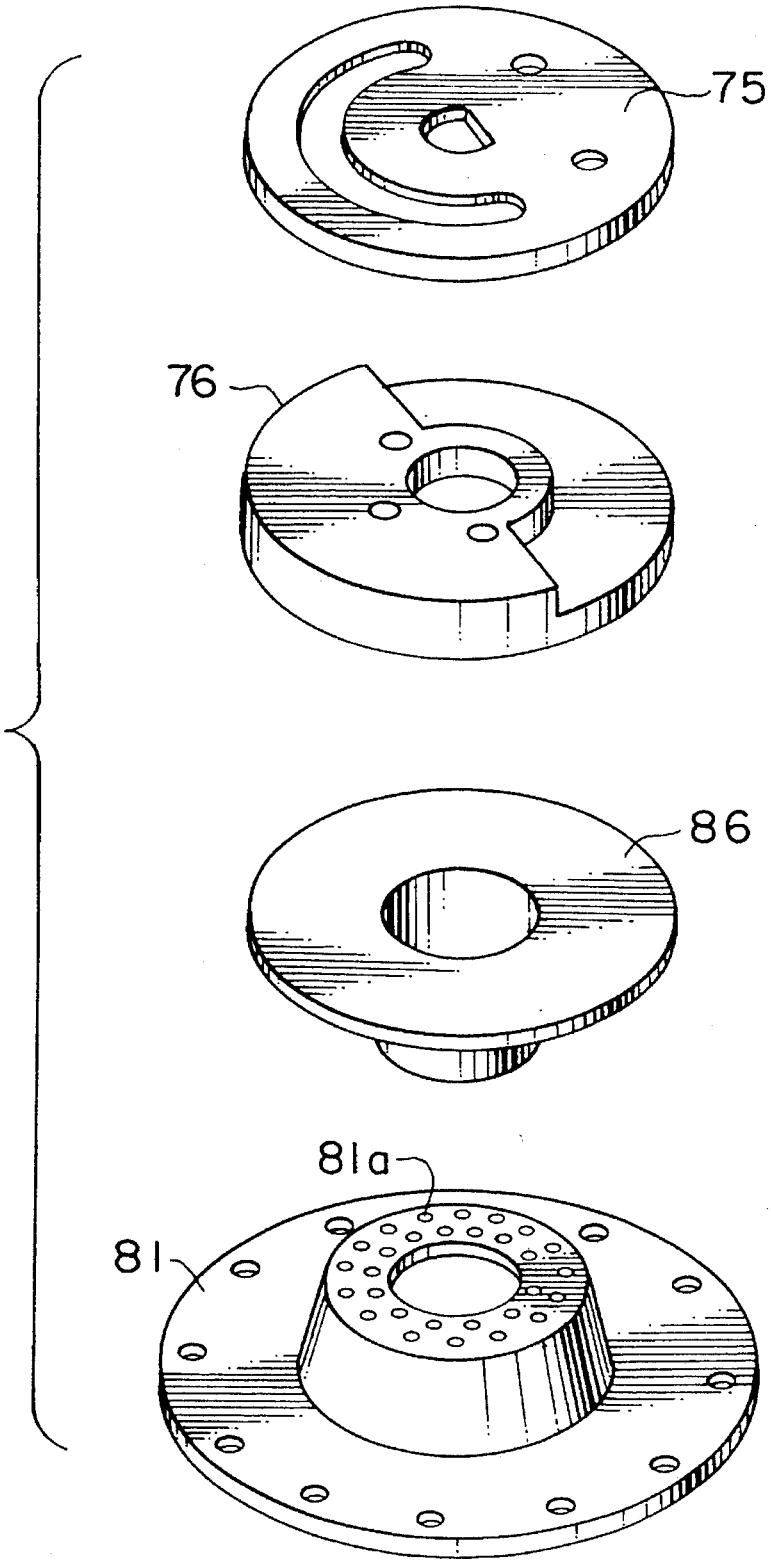
FIG. 10 is an perspective exploded view which illustrates small-size elements of the compressor.

According to the above-described embodiment, although the sliding gap between the wrap support disc 18*c* of the rotary scroll 18 and the thrust bearing 20 is sealed by only the oil film of the lubricating oil, an annular ring (82) shown in FIGS. 6 and 7 in Japanese Patent Application No. 63-159996 disclosed by the inventor of the present invention may be fastened to the back side of the wrap support disc 18*c*. In this case, the performance of sealing the gap in the sliding portion between the back pressure chamber 39 and the outer space 37 can be further improved.

Then, the operation of the second embodiment will now be described with reference to FIGS. 20 to 24.

The pressure in the motor chamber 6 which is filled with the discharged refrigerant gas with the lapse of time after the compressor start.

The lubricating oil in the discharge oil reservoir 34 in the bottom portion of the motor chamber 6 is, similarly to the case shown in FIG. 4, sucked into the oil chamber 278*a* via the oil hole 238*a* formed in the body frame 205 by the screw-pump operations of the spiral oil grooves 241*a* and 241*b* formed in the drive shaft 204. At this time, the partition cap 101 guides the lubricating oil to make it flow in the portion adjacent to the surface of the drive shaft 204 to be introduced into the oil chamber 278*a* and the spiral oil groove 241*b*. As a result, the lubricating oil is not influenced by the centrifugal dispersion due to the high speed rotation of the drive shaft 204 when it is introduced into the oil chamber 278*a* from the oil hole 238*a* so that it is sucked into the spiral oil groove 241*a*. As a result, a satisfactory screw-pump oil supply can be performed.

The lubricating oil supplied to the oil chamber 278*b* by the pressure difference between the discharge chamber oil reservoir 34 and the back pressure chamber 239 of the rotary scroll 218 and the screw-pump action performed by the spiral oil groove 241*b* lubricates the sliding surface of the rotary bearing 218*b* during it passes through the path. Then, it is introduced into the back pressure chamber 239 after it has passed through the throttle path 103, the annular groove 104 and the oil hole 105.

The lubricating oil in the oil chamber 278*a* the pressure level of which is substantially the same as that in the motor chamber 6 is lowered in pressure when it passes through the throttle path 103 and the oil hole 105. As a result, the pressure in the back pressure chamber 239 is brought to an intermediate level.

Similarly to the case shown in FIG. 4, the outer space 37 and the back pressure chamber 239 are allowed to communicate with each other via the oil groove 291 formed in the surface of the thrust bearing 220 only in the rotary angular range in which the compression chamber is subjected to the suction stroke. Therefore, the lubricating oil in the back pressure chamber 239 is intermittently supplied to the outer space 37.

The lubricating oil is then supplied to the compression chamber similarly to the case shown in FIG. 4 before it is again discharged to the motor chamber 6 together with the compressed refrigerant gas.

The lubricating oil supplied to the main bearing 212, the upper bearing 211 and the thrust bearing 213 by the screw-pump action performed by the spiral oil groove 241*a* is again gathered in the discharge chamber oil reservoir 34.

Since the other operations are the same as those according to the case shown in FIG. 4, their descriptions are omitted here.

Then, the operation of the third embodiment will now be described with reference to FIGS. 25 to 27.

Simultaneously with the compressor start, the lubricating oil in the discharge oil reservoir 34 in the bottom portion of the motor chamber 6 is sucked into the oil chamber 378*a* through the oil hole 338*a* formed in the body frame 305 by the screw-pump action performed by the spiral oil grooves 341*a* and 341*b* formed in the drive shaft 304 and by the trochoid pump device 106 disposed at the lower end portion of the drive shaft 304. At this time, the partition cap 101 guides, similarly to the case shown in FIG. 20, the lubricating oil to be introduced into the oil chamber 378*a* and the spiral oil groove 341*b* after it has passed through the portion adjacent to the surface of the drive shaft 304. Therefore, when the lubricating oil is introduced into the oil chamber 378*a* through the oil hole 338*a*, it is not influenced by the centrifugal dispersion due to the high speed (for example, 6000 rpm or higher) of rotation of the drive shaft 304 so that it is smoothly sucked into the spiral oil groove 341*a*. As a result, satisfactory screw-pump oil supply can be performed.

The lubricating oil introduced into the suction hole 108 formed in the trochoid pump device 106 after it has passed through the spiral oil groove 341*b* while lubricating the sliding surface of the rotary bearing 318*b*is discharged to the oil groove 111 before it is supplied to the main bearing 312 via the oil hole 112 and the radial directional oil hole 113. As a result, it is discharged to the oil reservoir 72. The lubricating oil passing through the spiral oil groove 341*a* while lubricating the main bearing 312 and discharged into the oil reservoir 72 joins the lubricating oil discharged from the trochoid pump device 106. A portion of the lubricating oil passes through the oil hole 38*b* while the pressure of which is reduced before it is intermittently supplied to the back pressure chamber 339.

The residual portion of the lubricating oil discharged into the oil reservoir 72 lubricates the upper bearing 311 and the thrust bearing portion 313 before it is gathered in the discharge chamber oil reservoir 34.

The pressure in the motor chamber 6 which is filled with the discharged refrigerant gas with the lapse of time after the compressor start is gradually raised. Therefore, the lubricating oil in the discharge chamber oil reservoir 34 is supplied to the back pressure chamber 339 also due to the pressure difference between the discharge chamber oil reservoir 34 and the back pressure chamber 339 of the rotary scroll 318.

Since the oil supply operation from the back pressure chamber 339 to the compression chamber and the other operations are the same as those according to the case shown in FIG. 20, their descriptions are omitted here.

Then, the operation of the fourth embodiment will now be described with reference to FIGS. 28 to 30.

Simultaneously with the compressor start, the crank shaft 414 performs the eccentric rotation by the rotation of the drive shaft 404. The rotary scroll 418 does not rotate on its own axis but it revolves around the main axis of the drive shaft 404 by the rotation prohibiting mechanism of the Oldham's ring 24 which is permitted to perform only the reciprocating motion.

While following the rotational motion performed by the rotary bearing 418*b* fixed to the rotary scroll 418, the piston 115 which engages with it performs the rotary motion. As a result, the front portion of the partition vane 117 is urged by the coil spring 116, causing a known oil supply pump which slidably comes in contact with the piston 115 perform the suction and discharge operations.

The lubricating oil in the discharge chamber oil reservoir 34 is introduced into the suction cut portion 114 via the oil hole 438*a* formed in the body frame 405 before it passes through the pump chamber and is discharged into the groove 119 of the side plate case 118. Then, it is supplied to the oil chamber 478*b* and the axial directional oil hole 112*a* formed in the drive shaft 404 from the oil chamber 478*a* also by the screw-pump action (the viscous pump action) performed by the spiral oil groove 441*b* while lubricating the sliding surface of the rotary bearing 414 so that it lubricates the sliding surface of the main bearing 412.

The lubricating oil sucked into the spiral oil groove 441*a* by the rolling piston type oil supply pump is supplied to the main bearing 412 by the screw-pump action before it joins the lubricating oil discharged from the axis directional oil hole 112. As a result, similarly to the case shown in FIG. 25, it is discharged to an oil reservoir 72 (omitted from illustration), the upper bearing and the thrust bearing portion and as well as supplied to the back pressure chamber 439 via the oil hole 438*a* while the pressure of which is being reduced. As a result, each sliding portion at the initial stage of the compressor start is lubricated.

The end portions of the opening side of the oil hole 438*b* of the back pressure chamber 439 is intermittently opened/closed by the reciprocating motion performed by the Oldham's ring 24. The continuously opened time is shortened in inverse proportion to the rotational speed of the drive shaft 404. Therefore, the introduction resistance into the back pressure chamber 439 is increased. As a result, the quantity of the lubricating oil to be introduced into the back pressure chamber 439 is decreased.

With the lapse of time after the compressor stat, the pressure of the discharged refrigerant gas acting on the discharge chamber oil reservoir 34 is raised. Then, the lubricating oil in the discharge chamber oil reservoir 34 is supplied to the oil chamber 478*a* also due to the pressure difference from the back pressure chamber 439. Then, it is supplied to each sliding portion by the screw-pump actions of the spiral oil grooves 441*a* and 441*b*.

By the oil supply means constituted by employing the above-described pressure-difference oil supply, the capacity type oil supply pump (the rolling piston type oil supply pump device) and the viscous pump (screw pump), satisfactory oil supply to the sliding portion can be continued even if a certain quantity of gas engagement takes place in the lubricating oil or if the oil supply performance of the capacity type oil supply pump or the viscous pump is deteriorated in the high speed operational region.

Since the other operations are the same as those according to the cases shown in FIGS. 4, 20 and 25, their descriptions are omitted here.

Then, the operation of the fifth embodiment will now be described with reference to FIGS. 31 to 33.

The piston 115 having the projecting portion 115*b* movably fitted to the cut groove 121 of the body frame 505 performs the swing motion when the rotary bearing 518*b* of the rotary scroll 518 performs the rotary motion so that the suction and discharge operations are performed. Since the gap is formed between the inner surface of the piston 115*a* and the small-diameter outer portion 518*f* of the rotary bearing 515*b*, the quantity of movement of the piston 115 is smaller than a value which is two times the quantity of eccentricity of the crank shaft 514. The size of the gap determines the discharge quantity possessed by the rotary cylindrical piston type oil supply pump. According to this embodiment, the quantity of movement of the piston 115*a* is established to a value corresponding to the quantity of eccentricity of the crank shaft 514 so as to restrict the input and to secure the oil supply quantity at the time of the high speed operation.

Simultaneously with the compressor start, the lubricating oil in the discharge chamber oil reservoir 34 is sucked into the suction hole 114*c* formed in the side plate 114*b* via the oil hole 538*a* before it is discharged through the groove 115*c* of the piston 115*a* and is then supplied to the oil chamber 578*a*.

The lubricating oil in the oil chamber 578*a* is supplied to the rotary bearing 518*b* and the main bearing 512 by the screw-pump action performed by the spiral oil groove 541*b* so that it is used to lubricate each sliding surface.

Since the ensuing operations are the same as those according to the above-described embodiments, their descriptions are omitted here.

Figure 35:
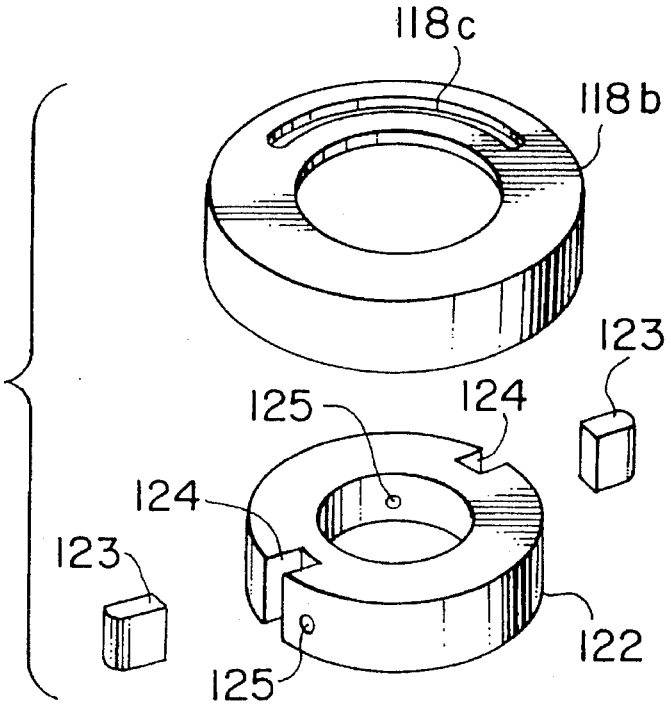
FIG. 35 is a perspective view which illustrates elements of an oil supply pump unit of the compressor.

Then, the operation of the sixth embodiment will now be described with reference to FIGS. 34 and 35.

Simultaneously with the compressor start, the rotor fixed to the drive shaft 604 is rotated, causing the vane 123 slidably fastened to the rotor 122 to be moved to the outer portion of the rotor 123 due to its centrifugal force. As a result, the pump chamber is sectioned so that known suction and discharge operations are performed.

The lubricating oil in the discharge oil reservoir 34 is sucked through the suction hole 118*c* of the side plate case 118*b*via the oil hole 638*a* before it is discharged into the oil chamber 678*a* via the discharge hole 125.

In a case where the pressure in the pump chamber is raised to exceed the predetermined pressure due to the high speed rotation of the drive shaft 604, the force of the lubricating oil acting on the front portion of the vane 123 from the pump chamber portion is made to be larger than the centrifugal force of the vane 123. As a result, the vane 123 is retracted, causing the gap between the pump chambers to be widened. As a result, the oil supply performance of the pump is controlled.

At the time of the extremely low speed operation, the centrifugal force of the vane 123 is small. Therefore, the sections in the pump chamber cannot be sufficiently formed, causing the oil supply performance of the pump to be restricted. As a result, the liquid refrigerant retained In the bottom portion of the discharge chamber oil reservoir 34 is not supplied to the bearing sliding portion at the initial stage at the cool start of the compressor.

With the lapse of time after the start of the compressor, the liquid refrigerant retained in the discharge oil reservoir 34 is separated from the lubricating oil while foaming so that it is moved to the upper portion of the motor chamber 6. Then, the oil supply pumping effect is sufficiently exhibited in the normal operational speed region of the compressor. As a result, the lubricating oil containing no refrigerant is supplied to each sliding portion.

Since the other operations are the same as those according to the case shown in FIG. 31, their descriptions are omitted here.

Then, the operation of the seventh embodiment will now be described with reference to FIG. 36.

The sucked refrigerant gas is introduced into the accumulator chamber 746 through the suction pipe 47 due to the rotation of the drive shaft 704. Then, the discharged refrigerant gas is, after it has been sucked and compressed, introduced into the oil separation chamber 128 via the discharge chamber 2, the gas path 780*b*, the gas path 780*a* and the discharge bypass pipe 127.

The discharged refrigerant gas introduced into the oil separation chamber 128 conflicts the upper frame 126 at which a portion of the lubricating oil is separated. Then, it cools the motor 703 via the gas hole 129 and the upper space of the motor chamber 706 while separating a portion of the lubricating oil. Then, it is discharged through the discharge pipe 731 disposed outside the lower motor coil end 130.

The lubricating oil separated from the discharged refrigerant gas in the oil separation chamber 128 lubricates the sliding surface of the bearing after it has passed through the spiral oil groove 741*d* formed in the top end shaft 704*d* of the drive shaft 704. Then, it is introduced into the motor chamber 706 before it is gathered in the discharge chamber oil reservoir 734 formed in its lower portion.

With the lapse of time after the start of the compressor, the pressure in the motor chamber 706 is raised. In accordance with this, the lubricating oil in the discharge chamber oil reservoir 34 is sucked into the oil chamber 778*a* via the oil hole 738*a* formed in the body frame 705 by the pressure difference from the back pressure chamber 739 and the screw-pumping action performed by the spiral oil grooves 741*a* and 741*b* formed in the drive shaft 704. Then, it is supplied to the main bearing 712 and the oil chamber 778*b*.

The lubricating oil in the oil chamber 778*b* is supplied to the main bearing 712 due to the centrifugal pumping oil supply action supplied via the axial directional oil hole 112. Then, it joins the lubricating oil which has passed through the spiral oil groove 741*a* before it is discharged into the oil reservoir 772.

The lubricating oil further lubricates the thrust bearing portion 713 before it is gathered in the discharge chamber oil reservoir 734 and the same is as well as reduced in its pressure at the throttle path portion in the oil hole 738*b* so as to be intermittently supplied to the back pressure chamber 739.

Since the portion between the oil reservoir 772 and the motor chamber 706 is gas-sealed by the film of the lubricating oil supplied to the thrust bearing portion 713, the refrigerant gas in the motor chamber 706 is not directly introduced into the back pressure chamber 739.

The release gap (see FIG. 13) on the back side of the thrust bearing 20 allowed to communicate with the compression chamber of the final compression stroke is communicated via the throttle path between the screw portion gap of the bolt 710 positioned at an intermediate position in the communication path. Therefore, the compressed refrigerant gas at the initial stage of the start of the compressor is introduced into the release gap while the pressure of which is reduced. As a result, although the gas pressure at the release gap is low immediately after the start of the compressor, it is raised with the lapse of time after the start of the compressor so that the thrust bearing 20 abuts against the fixed scroll 715 by the force of the gas back pressure.

The axial directional movement of the rotor 703*a* disposed between the thrust bearing portion 713 of the body frame 705 and the upper frame 126 is restricted by selecting the axial directional dimensions of the upper balance weight 775 and the lower balance weight 776.

The lower balance weight 776 slides on and comes in contact with the thrust bearing portion 776 so as to bear the weight of the drive shaft 704 and that of the rotor 703*a*.

The axial directional movements of the drive shaft 704 and the rotor 703*a* are generated at the time of the jumping phenomenon generated due to the incomplete flatness of the sliding surface when the lower balance weight 776 slides and comes in contact with the thrust bearing 713 at high speed. However, since the axial directional movement is restricted, the degree of the above-described movement can be reduced satisfactorily.

Since the other operations are the same as those according to the case shown in FIG. 4, their descriptions are omitted here.

Then, the operation of the eighth embodiment will now be described with reference to FIG. 37.

The refrigerant gas sucked through the suction pipe 47 is discharged into the outer refrigerating cycle through the upper discharge pipe 831 via the check valve chamber 50*a*, the discharge chamber 2, the gas path 880*b*, the gas path 880*b*, the discharge chamber 2*b*, the motor chamber 806, the gas hole 229 and the oil separation chamber 128*a* while cooling the motor 703 after it has been compressed in the compression chamber. The lubricating oil contained in the discharged refrigerant gas is primarily separated in the motor chamber 806 and is secondarily separated in the oil separation chamber 128*a* before the lubricating oil is gathered in the bottom portion at the central portion of the upper frame 126 which supports the top end portion of the drive shaft 704. Then, it lubricates the sliding surface of the bearing before it is returned to the motor chamber 706.

The oil supply to the main bearing 812 of the body frame 805, the thrust bearing portion, the back pressure chamber 839, the rotary bearing and the like are performed similarly to the case shown in FIG. 36.

Since the back side of the thrust bearing 220 is allowed to directly communicate with the discharge chamber oil reservoir 34 and the urging force for pressing the thrust bearing 220 against the fixed scroll 815 depends upon the pressure of the lubricating oil in the discharge chamber oil reservoir 34 and the elastic force of the coil spring 131 and the seal ring 70*a*, the force for supporting the thrust bearing 220 is small at the time of the initial stage of the cool start of the compressor at which the pressure in the motor chamber 806 is low. Therefore, the thrust bearing 220 cannot bear the load when the rotary scroll 818 is retracted toward the thrust bearing 220 due to the pressure in the compression chamber at the time of the start of the compressor. As a result, it is retracted in a direction in which the release gap is narrowed, causing the axial directional gap of the compression chamber to be enlarged. Therefore, the pressure in the compression chamber is rapidly lowered, causing the compression load at the time of the initial stage of the start of the operation is reduced.

A small gap is formed between the body frame 805 and the outer surface of the thrust bearing 220 so that the thrust bearing 220 is able to move in the axial direction. Therefore, the lubricating oil in the discharge chamber oil reservoir 34 is introduced into the above-described gap.

The above-described lubricating oil is subjected to the liquid compression process performed in the compression chamber so that the rotary scroll 818 is retracted toward the thrust bearing 220 and also the thrust bearing 220 is retracted. Therefore, it is introduced into the outer space 37 when the gap is formed between the thrust bearing 220 and the fixed scroll 815. As a result, the pressure of the back pressure chamber 839, which is allowed to communicate with the outer space 37, is quickly raised, causing the rotary scroll 818 to be pressed and thereby returned to the position toward the fixed scroll 815.

The liquid compression at the initial stage of the start of the compressor can be reduced or prevented by switching the electric supply circuit to the motor 703, the speed of which is varied by a DC power source, immediately before the start of the compressor in a state where the check valve device closes the discharge port to reversely rotate the motor 703 by two to three times at extremely low speed and to discharge the liquid refrigerant and the lubricating oil in the compression chamber into the accumulator chamber 846 and by forward rotating the motor 703.

Since the other operations are the same as those according to the cases shown in FIGS. 4 and 36, their descriptions are omitted here.

Then, the operation of the ninth embodiment will now be described with reference to FIG. 38.

The lubricating oil in the discharge chamber oil reservoir 34 which has been introduced into the back pressure chamber 939 after it has passed through the bearing sliding portion for supporting the drive shaft 4 and the bearing joint portion between the rotary scroll 918 and the drive shaft 4 urges the rotary scroll 918 against the fixed scroll 915 with its back pressure. Furthermore, the pressure of it is reduced and is introduced into the outer space 37 via the oil groove 291 formed in the thrust bearing 220 in a period in which the second compression chambers 51*a* and 51*b* are allowed to communicate with the suction chamber 17.

The lubricating oil introduced into the outer space 37 lubricates the sliding surface between the lap support disc 918*c* of the rotary scroll 918 and the thrust bearing 220 and the sliding surface between the lap support disc 918*c* and the end plate sliding surface 915*b*2 of the fixed scroll 915 before it is introduced into the oil hole 938*c* and the injection hole 952 in a period in which the second compression chambers 51*a* and 51*b* are allowed to communicate with the suction chamber 17 at which it is reduced in pressure. Then, it is introduced into the compression chamber so that the gap of the compression chamber is sealed by its oil film and it is mixed with the compressed gas before it is again discharged into the discharge chamber 2.

In a case where the pressure in the compression chamber is instantaneously abnormally raised due to the liquid compression operation performed in the compression chamber or the like, the compressed gas tend to reversely flow into the outer space together with the lubricating oil present in the path. However, its pressure level is lowered due to the influence of the viscous resistance of the lubricating oil retained in the oil reservoir path 938*e* or the passage resistance of the throttle path 938*d*. Furthermore, since the lap support disc 918*c* closes the end portion of the oil hole 938*c*, the reverse flow of it into the outer space 37 is prevented.

During the above-described compression stroke, the lap support disc 918*c* cuts off the portion between the outer space 37 and the back pressure chamber 939.

Since the other operations are the same as those according to the first and second embodiments, their descriptions are omitted here.

Then, the operation of the tenth embodiment will now be described with reference to FIG. 39.

The lubricating oil in the discharge chamber oil reservoir 2034 is introduced into the compression chamber via the following pressure difference path due to the pressure difference between the discharge chamber oil reservoir 2034, on which the discharge pressure acts, and the compression chamber. While it passes through the path, it is used to lubricate the sliding portion, give the back pressure to about the rotary scroll 2018 toward the fixed scroll 2015 and to seal with the oil film for the purpose of preventing the gas leakage from the gap between the sliding portions.

That is, the lubricating oil in the discharge chamber oil reservoir 2034 is introduced into the oil chamber 2078*a* via the oil suction path 2038 formed between the body frame 2005 and the fixed scroll 2015.

The lubricating oil in the oil chamber 2078*a* is supplied to the main bearing 2012 and the upper bearing 2011 by the spiral oil groove formed in the drive shaft 2004. Furthermore, it is secondarily reduced in pressure via the gap in the bearing between the crank shaft 2014 and the rotary bearing 2018*b*before it is introduced into the oil chamber 2078*b*. Then, it is secondarily reduced in pressure via the thin hole 2014 before it is introduced into the back pressure chamber 2039.

The opening portions of the two thin holes 2040 formed in the rotary boss portion 2018*e* facing the back pressure chamber 2039 are positioned adjacent to the key seat 2071*a* in the fastening and sliding portion between Oldham's ring 2024 and the body frame 2005. Therefore, the lubricating oil introduced from the oil chamber 2078*b* into the back pressure chamber 2039 is forcibly used to lubricate the sliding surface of the key groove 2071*a*.

The lubricating oil in the back pressure chamber 2039 passes through the two key grooves 2071 formed in the rotary scroll 2018 and the two shallow grooves 291 formed in the thrust bearing 220 before it makes a phase angle of 180° while lubricating the sliding surface of the key groove 2071. Then, it is intermittently introduced into the outer space 2037 from the opposite positions after they have been third reduced in pressure.

The path through which the lubricating oil is introduced from the outer space 2037 into the compression chamber is the same as that according to the first and second embodiments.

The drive shaft 2004 comes in contact with the end surface of the rotary boss portion 2018*e* of the rotary scroll 2018 by the pressure difference between the oil chamber 2078*a* and the oil chamber 2078*b* so as to be slidably supported.

The top end portion of the spiral oil groove formed in the drive shaft 2004 is not opened at the top end portion of the upper bearing 2011 and the bearing gap of the upper bearing 2011 is sealed by the film of the lubricating oil present in the bearing gap of the upper bearing 2011. Therefore, the discharged refrigerant gas is not introduced into the bearing and the back pressure chamber 2039.

The surface at which the fixed scroll 2015 and the body frame 2005 are coupled to each other is surrounded by the lubricating oil from the discharge chamber oil reservoir 2034. Therefore, the introduction of the high pressure refrigerant gas into the outer space 2037 via the above-described surface is prevented by the oil film enclosed in the above-described surface. Therefore, the introduction of the high pressure refrigerant gas into the outer space 2037 can be prevented.

The refrigerant gas introduced into the suction chamber 17 via the suction pipe 2047 is discharged into the discharge chamber 2 after it has been compressed. Then, it is discharged into the discharge chamber 2002*b* via the two discharge paths 2080 disposed symmetrically before it is supplied to the outer refrigerating cycle through the discharge pipe 2031 via the motor chamber 2006.

The pressure pulsation and the discharge noise of the discharge refrigerant as to be discharged into the discharge chamber 2002*b* from the discharge paths 2080 disposed symmetrically are interfered with each other and thereby damped. Then, the pressure pulsation is reduced when it is again equally discharged from the discharge chamber 2002*b* into the motor chamber 2006. As a result, the pressure pulsation of the motor chamber 2006 allowed to communicate with the external pipe system can be damped to a degree which does not influence the vibration of the external pipe system.

The discharge noise generated when the compressed refrigerant gas is discharged from the compression chamber to the discharge chamber 2 is shielded by the lubricating oil in the discharge chamber oil reservoir 2034 surrounding the compression chamber and the discharge chamber 2. Therefore, it is not transmitted to outside the sealed case 2001.

The discharge noise generated when the compressed refrigerant gas is discharged from the compression chamber to the discharge chamber 2 is raised in level in proportion to the operational speed of the compressor. In a case where the operational speed of the compressor is in the normal operational region (for example, 5000 rpm or lower), the discharge chamber 2002*b* may be eliminated and the discharged refrigerant gas may be directly discharged to the motor chamber 2006 through the two discharge paths 2080 extended (for example, a discharge path or discharge pipe is provided). In this case, the more the distance between the positions of the openings of the two discharged paths extended and disposed symmetrically, the discharge noise and the pressure pulsation can be damped satisfactorily.

Although the first to the tenth embodiments are described, a proper combination of the above-described embodiment may be employed to meet the operational conditions of the compressor.

(1) As described above, according to the above-described embodiments, the pressure of the discharged refrigerant gas introduced into the rotary scroll 18 opposing the compression chamber to urge the rotary scroll 18 toward the compression chamber and to make the axial directional gap of the compression chamber to be small. Furthermore, the tip seal 98 is disposed while allowing a small gap to be present in the spiral tip seal groove 98 formed at only the front portion of the rotary scroll wrap 18*a*. As a result, the rotary scroll 18 is pushed toward the fixed scroll 15 by the urged pressure of the discharged refrigerant gas introduced into the back pressure chamber 39 of the rotary scroll 18. Therefore, the enlarging of the axial directional gap of the compression chamber is prevented. As a result, the tip seal 98*a* will assuredly seal the axial directional gap between the front portion of the spiral wrap of the rotary scroll 18 and the fixed scroll 15 at which the leakage of the compressed gas will easily occur due to the dimensional deviation depending upon the combination of the parts of the two scrolls. A desired small gap (substantially no gap) can be secured in the axial directional gap between the front portion of the spiral wrap of the fixed scroll and the rotary scroll 18. Therefore, the sealing can be performed without the tip seal. As a result, the operation can be continued at the normal operation while reducing the compressed gas leakage.

In a case where the pressure in the compression chamber is abnormally excessively raised, the rotary scroll 18 is separated from the fixed scroll 15 in the axial direction. Therefore, the axial directional gap between the front portion of the spiral wrap of the fixed scroll and the rotary scroll 18 is enlarged, causing the refrigerant gas leak in the compression chamber to be generated instantaneously. Therefore, the pressure in the compression chamber can be rapidly lowered, causing the compression load to be reduced. As a result, the durability of the compressor can be improved.

(2) According to the above-described embodiments, the rotary scroll 18 is disposed between the body frame 5 and the fixed scroll 15 while keeping the axial directional gap. Furthermore, the thrust bearing 20 receiving the back side urging force toward the rotary scroll 18 by utilizing the pressure of the compressed refrigerant gas and disposed between the rotary scroll 18 and the body frame 5 acts to allow, by a small quantity, the maximum movable gap in the axial direction in which the oil film can be formed between the rotary scroll 18 and the fixed scroll. In a case where the thrust load acting due to the pressure of the compression chamber is larger than the back side urging force acting on the thrust bearing 20, the fact that the rotary scroll 18 is separated from the fixed scroll in the axial direction and retracting while pushing the thrust bearing 20 is allowed. Thus, the axial directional gap between the rotary scroll 18 and the fixed scroll 15 is enlarged. Furthermore, the compressed refrigerant gas to be introduced to the back side of the thrust bearing 20 is arranged to be introduced from the space in the final compression stroke of the compression chamber. Therefore, the pressure of the compressed refrigerant gas to be introduced into the back side of the thrust bearing 20 which supports the rotary scroll 18 at its portion opposing the compression chamber has not been raised at the time of the start of the compressor. When the rotary scroll 18 is separated from the fixed scroll by the pressure of the compression chamber and the pressure in the compression chamber is lowered due to the leakage of the compressed refrigerant gas from the compression chamber, causing the starting load to be reduced.

After the operation of the compressor has been commenced, the refrigerant gas which has been compressed completely can be introduced into the back side of the thrust bearing 20. As a result, the rotary scroll 18 can be supported by the thrust bearing 20 and the axial directional gap of the compression chamber can be retained to a small extent. Therefore, the operation can be started while realizing an excellent compression efficiency and reducing the compressed gas leakage at an early stage after the start of the compressor.

(3) According to the above-described embodiments, the rotary scroll 18 is disposed between the body frame 5 and the fixed scroll 15 while keeping the axial gap. The thrust bearing 20 arranged to receive the back side urging force toward the rotary scroll 18 by utilizing the pressure of the compressed refrigerant gas and disposed between the rotary scroll 18 and the body frame 5 allows the rotary scroll 18 to have a small degree of the axial directional maximum movable gap with which the oil film can be formed between the rotary scroll 18 and the fixed scroll 15. Therefore, when the thrust load acting due to the pressure of the compression chamber is larger than the back side urging force acting on the thrust bearing 20, the fact that the rotary scroll 18 separates from the fixed scroll in the axial direction and retracts while pushing the thrust bearing 20 is allowed. Furthermore, the axial directional gap between the rotary scroll 18 and the fixed scroll 15 is arranged to be enlarged. Furthermore, the compressed refrigerant gas to be introduced to the back side of the thrust bearing 20 is arranged to be introduced from compression chamber allowed to communicate with the discharge chamber 2 and the throttle path is formed at the intermediate position of its introduction path (the thrust back pressure introduction hole 89*a* and the thrust back pressure introduction hole 89*b*). Therefore, the pressure of the refrigerant gas, which has been completely compressed, to be introduced to the back side of the thrust bearing 20 which supports the rotary scroll 18 at its portion opposing the compression chamber is reduced at the intermediate position of its introduction path so as to reduce the back pressure urging force acting on the thrust bearing 20. As a result, the rotary scroll 18 is separated from the fixed scroll 15 by the pressure of the compression chamber, causing the refrigerant gas in the compression chamber to be leaked. As a result, the low load start of the operation can be performed. With the lapse of time after the start, the pressure of the refrigerant gas introduced into the back side of the thrust bearing 20 is gradually raised. Therefore, the back pressure urging force acting on the thrust bearing is gradually enlarged. Then, the rotary scroll can be supported by the thrust bearing 20 and the small axial directional gap of the compression chamber can be gradually retained. As a result, the operation can be gradually shifted to the full load operation simultaneously with the start of the supply of the lubricating oil to the sliding portions after the start of the operation.

As a result, the rapid load change in the initial stage at the start of the operation of the compressor can be prevented and the generations of the vibration and noise at the initial stage of the start of the operation can be prevented. In addition, the durability of the compressor can be improved.

INDUSTRIAL APPLICABILITY

As described above, the structure is arranged in such a manner that the rotary scroll is urged toward the compression chamber by utilizing the pressure of the compressed fluid introduced into the rotary scroll in the portion opposing the compression chamber to retain the small axial directional gap of the compression chamber. Furthermore, the seal member is disposed while allowing the small gap in the spiral groove formed at only the front portion of the rotary scroll wrap. As a result, the urging pressure of the discharged fluid introduced into the back pressure chamber of the rotary scroll is used to push the rotary scroll toward the fixed scroll so that the enlargement of the axial directional gap of the compression chamber is prevented. As a result, the seal member will assuredly seal the axial directional gap between the front portion of the spiral wrap of the fixed scroll and the rotary scroll at which the leakage of the compressed gas will easily occur due to the dimensional deviation depending upon the combination of the parts of the two scrolls. Therefore, a desired small gap (substantially no gap) can be secured in the axial directional gap between the front portion of the spiral wrap of the fixed scroll and the rotary scroll. Therefore, the sealing can be performed without the tip seal. As a result, the operation can be continued at the normal operation while reducing the compressed gas leakage.

In a case where the pressure in the compression chamber is abnormally excessively raised, the rotary scroll is separated from the fixed scroll in the axial direction. Therefore, the axial directional gap between the front portion of the spiral wrap of the fixed scroll and the rotary scroll is enlarged, causing the refrigerant gas leakage in the compression chamber to be generated instantaneously. Therefore, the pressure in the compression chamber can be rapidly lowered, causing the compression load to be reduced. As a result, the durability of the compressor can be improved.

The second invention is constituted in such a manner that the rotary scroll is disposed between the stationary member for fixing the fixed scroll and the fixed scroll while maintaining the axial directional gap. Furthermore, the thrust bearing receiving the back side urging force toward the rotary scroll by utilizing the pressure of the compressed fluid and disposed between the rotary scroll and the stationary member allows the rotary scroll to have a small maximum axial directional movable gap with which the oil film can be formed between the rotary scroll and the fixed scroll. As a result, in a case where the thrust load acting due to the pressure of the compression chamber is larger than the back side urging force acting on the thrust bearing, the fact that the rotary scroll separates from the fixed scroll in the axial direction and retracts while pushing the thrust bearing is allowed. As a result, the axial directional gap between the rotary scroll and the fixed scroll is enlarged. Furthermore, the compressed fluid to be introduced into the back side of the thrust bearing is introduced from the space in the final compression stroke of the compression chamber. As a result, the pressure of the compressed gas to be introduced into the back side of the thrust bearing which supports the rotary scroll in the portion opposing the compression chamber is not raised at the time of the start of the compressor. In addition, the rotary scroll is separated from the fixed scroll by the pressure of the compression chamber to cause the compressed gas in the compression chamber to leak. As a result, the pressure in the compression chamber is reduced so that the load at the start of the operation can be reduced.

Furthermore, after the start of the operation of the compressor, the gas which has been completely compressed can be introduced into the back side of the thrust bearing. As a result, the rotary scroll can be supported by the thrust bearing and the small axial directional gap of the compression chamber can be retained. Therefore, the operation while exhibiting an excellent compression efficiency can be started at the early stage after the start of the compressor.

The third embodiment is constituted in such a manner that the rotary scroll is disposed between the stationary member for fixing the fixed scroll and the fixed scroll while retaining an axial directional gap. Furthermore, the thrust bearing receiving the back side urging force toward the rotary scroll by utilizing the pressure of the compressed fluid and disposed between the rotary scroll and the stationary member allows the rotary scroll to have a small maximum axial directional movable gap with which the oil film can be formed between the rotary scroll and the fixed scroll. As a result, in a case where the thrust load acting due to the pressure of the compression chamber is larger than the back side urging force acting on the thrust bearing, the fact that the rotary scroll separates from the fixed scroll in the axial direction and retracts while pushing the thrust bearing is allowed. As a result, the axial directional gap between the rotary scroll and the fixed scroll is enlarged. Furthermore, the compressed fluid to be introduced into the back side of the thrust bearing is introduced from the compression chamber allowed to communicate with the discharge chamber. Furthermore, a throttle path is formed at an intermediate position of the introduction path. Therefore, the gas which has been completely compressed and to be introduced into the back side of the thrust bearing which supports the rotary scroll in its portion opposing the compression chamber at the initial stage of the start of the operation of the compressor is reduced in pressure at an intermediate position of the introduction path. Therefore, the back pressure urging force acting on the thrust bearing is reduced so as to separate the rotary scroll from the fixed scroll by the pressure of the compression chamber. As a result, gas in the compression chamber is leaked so that the low load start operation can be performed.

With the lapse of time after the start of the operation, the pressure of the compressed gas introduced into the back side of the thrust bearing is gradually raised and the back pressure urging force acting on the thrust bearing is gradually enlarged. Then, the rotary scroll can be supported by the thrust bearing and the small axial directional gap of the compression chamber can be retained. As a result, the operation can be gradually shifted to the full load operation simultaneously with the start of the supply of the lubricating oil to the sliding portion after the start of the operation.

As a result, the rapid load change at the initial stage of start of the compressor can be prevented and the vibration and noise at the initial stage of the start of the operation can be prevented. In addition, the durability of the compressor can also be improved.

What is claimed is:

1. A scroll compressor comprising:

a fixed scroll having a first wrap support disk and a first spiral scroll wrap thereon, said first spiral scroll wrap having a forward end;

an orbital scroll having a second wrap support disk and a second spiral scroll wrap thereon, said fixed scroll and said orbital scroll being disposed to define a compression chamber therebetween, said second spiral scroll wrap having a forward end;

means for causing said orbital scroll to orbit relative to said fixed scroll to reduce a volume of said compression chamber to compress a fluid in said compression chamber; and an elastic seal member disposed in the forward end of only a first one of the first spiral scroll wrap and the second spiral scroll wrap, said elastic seal member contacting a second one of said first wrap support disk and said second wrap support disk;

said forward end of said second one of said first spiral scroll wrap and said second spiral scroll wrap directly facing said first one of said first wrap support disk and said second wrap support disk.

2. A scroll compressor according to claim 1, wherein the fixed scroll further has a bearing surface on said first wrap support disk for supporting the orbital scroll thereon, the forward end of the first spiral scroll wrap faces directly to the orbital scroll, and the forward end of the first spiral scroll wrap and the bearing surface extend on a plane.

* * * * *